US010160027B2

(12) United States Patent
Baker et al.

(10) Patent No.: US 10,160,027 B2
(45) **Date of Patent: *Dec. 25, 2018**

(54) APPARATUS FOR CLOSING PITTSBURGH SEAMS ASSOCIATED WITH DUCT ASSEMBLIES AND OTHER BOX-SHAPED MEMBERS

(71) Applicant: Vicon Machinery, LLC, Pevely, MO (US)

(72) Inventors: Paul L. Baker, St. Charles, MO (US); Bert Michael Fischer, Festus, MO (US)

(73) Assignee: Vicon Machinery LLC, Pevely, MO (US)

( * ) Notice: Subject to any disclaimer, the term of this patent is extended or adjusted under 35 U.S.C. 154(b) by 226 days.

This patent is subject to a terminal disclaimer.

(21) Appl. No.: 15/175,210

(22) Filed: Jun. 7, 2016

(65) Prior Publication Data

US 2016/0288192 A1 Oct. 6, 2016

Related U.S. Application Data

(63) Continuation-in-part of application No. 13/715,209, filed on Dec. 14, 2012, now Pat. No. 9,623,472, which is a continuation-in-part of application No. 13/358,972, filed on Jan. 26, 2012, now Pat. No. 9,375,776.

(60) Provisional application No. 61/436,599, filed on Jan. 26, 2011.

(51) Int. Cl.
*B21D 39/02* (2006.01)

(52) U.S. Cl.
CPC ..... *B21D 39/023* (2013.01)

(58) Field of Classification Search
CPC ..... Y10T 29/49915; Y10T 29/53522; Y10T 29/5122; Y10T 29/5397; Y10T 29/53787; Y10T 29/53791; B21D 5/002; B21D 5/14; B21D 19/043; B21D 39/021; B21D 39/02; B21D 39/023; B21D 53/74; B23P 19/04; B23P 19/10
See application file for complete search history.

(56) References Cited

U.S. PATENT DOCUMENTS 2,076,228 A 4/1937 Dressing
2,330,756 A 9/1943 Stanger
3,015,293 A 1/1962 Parham
(Continued)

*Primary Examiner* — Pradeep C Battula
(74) *Attorney, Agent, or Firm* — Husch Blackwell LLP

(57) ABSTRACT

A vertical Pittsburgh Seam closing apparatus having a base supporting surface, a track mechanism for moving a carriage assembly which holds seam forming members used to close a Pittsburgh Seam, a pair of upper and lower guide members for guiding the duct section into a proper vertical position, and upper and lower clamping members positioned inside the duct section and adjacent the inside portion of the Pittsburgh Seam to be closed, the upper guide members and clamping member being selectively movable and adjustable for accommodating different duct section lengths. In one embodiment, the seam forming assembly includes a plurality of members mounted in vertical arrangement, at least one of the plurality of seam forming members being shaped to initially bend the overhanging edge portion and at least one of the plurality of seam forming members having a substantially V-shaped configuration for closing the Pittsburgh Seam.

32 Claims, 12 Drawing Sheets

(56) References Cited

U.S. PATENT DOCUMENTS

| | | | |
|---|---|---|---|
| 3,188,729 | A | 6/1965 | Pogue, Jr. |
| 3,487,669 | A | 1/1970 | Kemp |
| 4,395,894 | A | 8/1983 | McCorvey |
| 5,105,640 | A | 4/1992 | Moore |
| 5,189,784 | A | 3/1993 | Welty |
| 5,243,750 | A | 9/1993 | Welty |
| 5,353,616 | A | 10/1994 | Fischer |
| 5,720,095 | A | 2/1998 | Lennartsson |
| 6,460,573 | B1 | 10/2002 | Fischer et al. |
| 6,471,256 | B1 | 10/2002 | Fischer |
| 6,715,329 | B1 | 4/2004 | Hametner |
| 6,810,570 | B2 | 11/2004 | Fischer et al. |
| 6,981,398 | B2 | 1/2006 | Toben et al. |
| 8,561,448 | B2 | 10/2013 | Borwig |

APPARATUS FOR CLOSING PITTSBURGH SEAMS ASSOCIATED WITH DUCT ASSEMBLIES AND OTHER BOX-SHAPED MEMBERS

CROSS REFERENCE TO RELATED APPLICATION

This application is a continuation-in-part of U.S. patent application Ser. No. 13/715,209 (now U.S. Pat. No. 9,623,472) filed Dec. 14, 2012, which is a continuation-in-part of U.S. patent application Ser. No. 13/358,972 (now U.S. Pat. No. 9,375,776) filed on Jan. 26, 2012, both of which are entitled Apparatus For Closing Pittsburgh Seams Associated With Duct Assemblies and Other Box-Shaped Members, and claims priority to and the benefit of U.S. Provisional Patent Application Ser. No. 61/436,599 filed on Jan. 26, 2011 and entitled Apparatus For Closing Pittsburgh Seams Associated With Duct Assemblies and Other Box-Shaped Members, the entire disclosures of which are incorporated herein by reference.

BACKGROUND OF INVENTION

The present invention relates generally to forming duct assemblies for transporting pressurized fluid therethrough such as heating and cooling air and, more particularly, to an apparatus for mechanically closing one or more Pittsburgh Seams associated with metal duct sections used to form duct assemblies commonly associated with forced air HVAC systems.

Rectangular or box-shaped duct assemblies are extensively used in both commercial and residential applications to transport and distribute heated or cooled air to a building, personal residence, or other structure. Duct assemblies are conventionally formed in sections and secured together to form longer spans as needed. A duct section is typically formed of sheet metal into a rectangular shape having four sides which are joined together through the use of one or more commonly employed Pittsburgh Seams.

Each duct section can be formed using a plurality of different forming techniques such as bending two pieces of sheet metal of the desired length at a 90° angle and joining such sections together along opposed complimentary edges through the use of a conventional Pittsburgh Seam. This application requires the use of two Pittsburgh Seams. In another method and application, all four sides of a typical duct section can be formed in a single continuous process requiring the use of a single Pittsburgh Seam to join the two opposite ends of the sheet metal to form the completed duct section. In this application, a single Pittsburgh Seam is needed to complete the process. Still other methods and applications may require the use of more than two Pittsburgh Seams depending upon the shape and configuration of the duct section. Regardless of the number of Pittsburgh Seams utilized in a particular duct assembly, these seams must be properly closed as will be hereinafter explained.

Pittsburgh Seams are commonly used to join the seams of metal duct sections, whether these sections are rectangular, tapered, rounded, or some other configuration. A Pittsburgh Seam includes a male portion and a female portion, the male portion being associated with one edge portion of the sheet metal portion forming the duct section and the female portion being associated with a corresponding edge portion associated with another sheet metal portion forming the duct section. The male portion of the Pittsburgh Seam includes a flange portion formed along the length of one edge of the sheet metal portion which is bent over at approximately a 90° angle and is insertable into a groove or cavity associated with the female portion of the Pittsburgh Seam, the female portion including an overhanging edge portion which extends beyond the partially formed seam for bending to complete the closing of the seam. During assembly of a particular duct section, the male portion of the Pittsburgh Seam associated with one edge portion of a duct portion is insertable into the female portion associated with another edge portion of a duct portion so as to leave an overhanging edge portion extending beyond the partially formed seam. When the various parts of the duct section are thus pre-assembled and the duct section is formed, the Pittsburgh Seams, although engaged, will not be closed or locked. In order to lock or close these seams, it is necessary to bend the overhanging edge portion of the Pittsburgh Seam extending beyond the partially formed seam inwardly so that it lies adjacent to and against the outer surface of the sheet metal portion incorporating the male portion of the Pittsburgh Seam. When this overhanging edge portion is bent into proper position, the Pittsburgh Seam will be closed and locked.

At the present time, the commonly used Pittsburgh Seam is closed either manually using a hand hammer or a power tool, or it is mechanically bent using known Pittsburgh Seam closer apparatus such as the apparatus disclosed in U.S. Pat. Nos. 5,189,784; 5,243,750; and 5,353,616. Manual closing of the Pittsburgh Seam is time consuming, tedious, and creates a large amount of noise. The known apparatus for mechanically closing a Pittsburgh Seam require a specific orientation of the seam within the closing apparatus in order to be effective and operative in closing such seam. In this regard, operators must turn and orient the duct section so as to match the direction of the machine in closing the seam. If the duct section is not properly oriented, the seam will not be closed and a reject will occur. In addition, the known Pittsburgh Seam closing apparatus do not always provide sufficient strength and support to various parts of the apparatus depending upon the force required and exerted during the seam closing process when heavier gauges of sheet metal are used to form a particular duct section; and the known prior art apparatus are not easily adjustable to accommodate different lengths of duct sections to be seamed without changing supports and other parts of the apparatus. In some circumstances, the known prior art apparatus can only accommodate certain known standard sizes of duct sections. Some of the known prior art apparatus likewise bend the sheet metal against the side wall of the duct section during the seam closing process producing wrinkles or waves in the duct seam.

It is therefore desirable to provide an improved Pittsburgh Seam closing apparatus which will close a Pittsburgh Seam regardless of the orientation in which the duct section is placed within the apparatus, thereby improving not only the efficiency of the seam closing process but also the efficiency of the entire assembly process in forming a duct section and moving such formed duct section to the Pittsburgh Seam closer apparatus. It is also desirable to improve the overall strength of the machine and particularly the seam forming roller components and to provide an improved clamping arrangement whereby successful seaming can be accomplished from extremely light gauge metal, for example 26 gauge metal, through heavy gauge metal, for example 16 gauge metal, without the need to adjust the seam forming rollers for a tighter or looser setting. Known existing machines require adjustments for this range of metal in order to close the seam adequately or to keep from damaging either the machine or the duct section. Still further, it is also desirable to provide a Pittsburgh Seam closing device which is easily and quickly adaptable for accepting and closing Pittsburgh Seams associated with duct sections of any length within the machine's overall capacity without changing supports or other components of the overall apparatus. This feature will allow non-standard or odd sized duct sections to be seamed efficiently. The known existing machines are typically set for production of standard lengths of duct section and they do not allow for the closing of Pittsburgh Seams associated with odd sizes of duct sections, which odd sizes are necessary and exist in every installation. Instead, these odd sized duct sections are typically seamed manually by using a hammer.

Still further, it is likewise desirable to provide a Pittsburgh Seam closing apparatus wherein seam closing is accomplished without producing waves or wrinkles in the duct seam.

Accordingly, the present invention is directed to overcoming one or more of the problems as set forth above.

SUMMARY OF INVENTION

The present invention overcomes many of the shortcomings and limitations of the known prior art devices discussed above and teaches the construction and operation of several embodiments of a vertical Pittsburgh Seam closing apparatus which includes an improved seam forming assembly and carriage which enables the duct section to be positioned vertically on the machine regardless of the particular orientation of the Pittsburgh Seam thereby eliminating the need to orient or turn the duct section so as to match a particular direction of movement which is necessary when using existing machines. The positioning, shape and orientation of the seam forming assembly associated with the present apparatus likewise minimizes the amount of manual peening necessary to close opposite end portions of the Pittsburgh Seam prior to positioning the duct section on the present apparatus. The present apparatus also includes improved clamping means for clamping and holding a vertically oriented duct section on the present device regardless of the orientation of the Pittsburgh Seam, and improved adjustment means for easily adjusting the upper clamp head assembly for receiving duct sections of any length within the overall dimensions of the apparatus support frame and track assembly for accommodating non-standard lengths of duct sections which typically exist in every installation and need to be seamed.

In one aspect of the present invention, the present Pittsburgh Seam closing apparatus includes a base member having a supporting surface associated therewith for positioning and locating a duct section in a vertical orientation relative to the present apparatus. A suitable support framework is positioned on or adjacent one side of the base member and includes a vertical track mechanism for moving a carriage assembly which holds the seam forming or bending members used to close a Pittsburgh Seam. The base member includes a pair of lower guide members or clamp pads forming a lower guide assembly wherein the guide members are arranged substantially perpendicular to each other and are positioned in the shape of a "V" on the supporting surface for guiding the duct section and the associated Pittsburgh Seam into proper positioning on the base member. The V-shaped guide members or clamp pads are positioned and located and are adjustable such that the seam forming assembly is centrally positioned therebetween. The V-shaped clamp pads allow the duct section to be pressed into an interference fit with the seam forming assembly and also provides proper orientation of the duct section relative to the seam forming assembly.

The supporting surface further includes an elongated opening which is positioned and located in alignment with the seam forming assembly and includes a lower clamp head assembly having a clamping member which is pivotally rotatable between an unclamped position and a position where the clamping member is positioned inside the duct section and adjacent the inside portion of the Pittsburgh Seam to be closed. The lower clamp head assembly includes an actuator which pivotally rotates the clamping member between its clamped and unclamped position. The actuator can be electrically, hydraulically or pneumatically controlled from a control panel associated with the present apparatus. In addition, the clamping member includes a specially configured mating portion which enables the clamping member to properly engage and support the inside portion of the Pittsburgh Seam regardless of the orientation of the Pittsburgh Seam, and regardless of which side of the seam the female portion is located.

A similarly constructed upper clamp head assembly is mounted on a selectively movable and adjustable assembly such that the entire upper clamp head assembly can be moved and adjusted to accommodate any duct section length. The upper clamp head assembly likewise includes a pair of V-shaped guide members forming an upper guide assembly positioned in vertical alignment with the lower guide members for likewise guiding the upper portion of the duct section into proper position on the present apparatus. The upper clamping member is substantially identical to the lower clamping member and is likewise pivotally rotatable between an unclamped position and a clamped position where the clamping member is positioned inside the duct section and adjacent the inside portion of the Pittsburgh Seam to be closed. The upper clamping member is likewise pivotally rotated through the use of an actuator which is likewise controlled from a control panel associated with the present device. Once a particular duct section is positioned within the upper and lower guide members and the upper and lower clamping members are moved to their clamping positions, the duct section is properly oriented and positioned on the present apparatus and is ready for operative sealing of the Pittsburgh Seam.

In one embodiment, the present seam forming assembly includes a pair of roller members mounted in vertical arrangement to each other, the lower roller member being V-shaped in configuration and the upper roller member being substantially cylindrical in shape. The V-shaped forming roller member enables the Pittsburgh Seam to be positioned within the upper and lower guide members in any of the two possible orientations, namely, with the female portion of the seam located on either the left or right side of the seam, and, regardless of such orientation, the present apparatus still effects proper closure of the seam as will be hereinafter explained. Both seam forming members are positioned on a movable carriage, the carriage being guided on a vertical track system through the use of a chain and sprocket type assembly which is powered in a conventional manner through the use of a drive motor. The vertical track arrangement upon which the seam forming assembly moves is adjustable fore and aft relative to the upper and lower guide plates, if necessary, to produce sufficient force and interference between the forming members and the Pittsburgh Seam associated with the duct section clamped into position on the present device.

When activated, the carriage assembly carrying the seam forming assembly moves in a vertical direction from its lower start position to an upper position determined by the positioning of the upper clamp head assembly and then returns to its lower start position. As the seam forming assembly moves in an upward direction, the substantially cylindrically shaped roller member initially bends the overhanging seam edge portion approximately 45° and the bottom V-shaped roller member then completes the closing of the seam and moves the overhanging edge portion into a tight abutting relationship with the duct section. Because of its V-shape, the side of the V-shaped roller member not being used to form or close the seam holds one side of the duct section and supports that side of the duct section so that the opposite side of the duct section to be seamed presses against it to create the bending or forming action. In other words, one side of the V-shaped roller member holds the duct section in proper position while the other side of the V-shaped roller member actually bends the overhanging edge portion of the Pittsburgh Seam into its closed position. As a result, it makes no difference if the overhanging edge portion of the Pittsburgh Seam extends in a direction corresponding to either side of the V-shaped roller member since one side of the V-shaped roller member will bend the Pittsburgh Seam while the other side will provide sufficient support and force for completing the bending or forming action along the entire length of the seam. This is a substantial improvement over known existing apparatus which typically do not provide adequate support along the entire length of the seam.

When the seam forming assembly reaches the top of the duct section, it is returned to its lower start position by traversing the full length of the seam in the opposite direction. During this return run, the seam forming assembly will re-form the metal of the seam, if necessary, so as to remove any waves or wrinkles in the duct seam. Once the seam has been closed, the upper and lower clamp assemblies are moved to their unclamped position, and the duct section can be removed and rotated so that another seam can be positioned for closure.

In another aspect of the present invention, the top cylindrical seam forming roller can be replaced with a flat plate, a wiper block or other object which will bend the overhanging edge portion of the Pittsburgh Seam at least approximately 45° as previously explained. It is not necessary to have a roller member as the second seam forming member as described in the first embodiment. Any object and any configuration of such object which will achieve bending of the overhanging edge portion of the Pittsburgh Seam to approximately a 45° angle will achieve the stated purpose and will allow the V-shaped forming roller to complete the seaming process.

In still another aspect of the present invention, a second seam forming assembly and carriage can be positioned adjacent the upper guide members and can be operable independent of the lower seam forming assembly and carriage such that a dual carriage system can be achieved. In this particular embodiment, the lower seam forming assembly can move upwardly and traverse the vertical track a distance less than the full length of the duct section to be seamed and the upper seam forming assembly can move downwardly and traverse a distance less than the full length of the duct section to be seamed, but a distance which will overlap the seaming process of the lower seam forming assembly so as to ensure complete seaming of the Pittsburgh Seam to be closed. When both carriage systems return to their start position, the seaming process is complete. The timing of the independent movement of the two carriage systems can be computer controlled or manually controlled. The configuration of the upper seam forming carriage assembly will have the V-shaped roller member positioned above the cylindrical roller member or other forming member thereby allowing the seam forming assembly to be positioned closer to the terminal end portion of the seam to be closed. This results in less peening of that particular seam end portion as compared to the embodiment where a single seam forming roller carriage assembly is utilized. The second or upper seam forming carriage assembly will move on the same track as the lower assembly via a chain and sprocket assembly substantially similar to the lower carriage assembly. Other means for moving the second seam forming carriage assembly are likewise envisioned and anticipated such as by using another track system.

In still another embodiment, the present seam forming assembly includes three roller members mounted in vertical arrangement to each other, the center roller member being V-shaped in configuration and the upper and lower roller members being substantially cylindrical in shape. These three roller members are positioned on a movable carriage assembly substantially similar to the carriage assembly carrying the pair of roller members, this three roller carriage assembly likewise being guided on a vertical track system in a conventional manner. Like the pair of seam forming roller members, these three roller members likewise enable the Pittsburgh Seam to be positioned within the upper and lower guide members regardless of their orientation, the advantage of the three roller members being that the carriage assembly carrying these roller members can effectively close the Pittsburgh Seam in a single pass in either direction, either during its upward travel, or during its downward trend. The positioning of a substantially cylindrical roller member on either side of the V-shaped forming roller member enables a new Pittsburgh Seam to be closed to be positioned within the present device once the carriage assembly reaches its upper position and this new Pittsburgh Seam can be closed when the carriage assembly is moved from its upper position to its lower start position.

In this regard, when the three roller carriage assembly moves from its lower position to its upper position, the upper substantially cylindrically shaped roller member will initially bend the overhanging seam edge portion approximately 45° and the center V-shaped roller member will then complete the closing of the seam as previously described. The bottom substantially cylindrically shaped roller member will not affect the seam closing process during upward travel of the carriage assembly. When the carriage assembly reaches its upper position, the duct seam is completely closed and the duct section can be removed and rotated so that another seam, or another duct section, can be positioned for closure. When the carriage assembly moves from its upper position to its lower position, the lower substantially cylindrically shaped roller member will initially bend the overhanging seam edge portion approximately 45° and the center V-shaped roller member will again complete the closing of the seam as previously described. The upper substantially cylindrically shaped roller member will not affect the seam closing process during downward travel of the carriage assembly. This embodiment allows a single carriage assembly to completely close a Pittsburgh Seam in a single pass across the seam. This increases productivity of the present device and is more efficient as compared to the carriage assembly which only includes a pair of seam forming roller members.

In still another aspect of the present invention, the present seam forming assembly and carriage can be constructed to include any plurality of members mounted in vertical arrangement within the carriage assembly wherein at least one of the plurality of seam forming members is shaped to initially bend the overhanging seam edge portion, and at least one of the plurality of seam forming members is a roller member having a substantially V-shaped configuration. This plurality of seam forming members can include a plurality of four seam forming members, a plurality of five seam forming members, or any plurality of members as will be hereinafter further explained.

It is also recognized and anticipated that more than one seam forming member can be utilized to initially bend the overhanging Pittsburgh Seam edge portion. In this regard, any plurality of seam forming members can be utilized to initially bend the overhanging edge portion wherein one of the plurality of seam forming members bends the overhanging Pittsburgh Seam edge portion a first predetermined amount, a second of the plurality of seam forming members bends the overhanging Pittsburgh Seam edge portion a second predetermined amount, and any remaining plurality of seam forming members utilized to initially bend the overhanging Pittsburgh Seam edge portion continued to bend the overhanging seam edge portion progressive amounts until the overhanging Pittsburgh Seam edge portion is initially bent in the neighborhood of approximately 45°. The plurality of seam forming members utilized to initially bend the overhanging Pittsburgh Seam edge portion can take on a wide variety of different shapes including a plurality of substantially V-shaped roller members having progressively varying slopes or tapers associated with their respective side portions, a substantially inverted V-shaped roller member, and other member shapes as discussed above. Any shaped roller member, or any shaped plurality of roller members, can be utilized to initially bend the overhanging Pittsburgh Seam edge portion to approximately 45° as previously explained.

It is also recognized that any plurality of substantially V-shaped roller members can be utilized to thereafter complete the closing of the Pittsburgh Seam. In this regard, each substantially V-shaped roller member will have a different slope or taper associated with its sidewalls such that the first substantially V-shaped roller member will start the closing process and will move the Pittsburgh Seam to a first predetermined amount or position towards closing, and then the subsequent V-shaped roller members will continue to move the Pittsburgh Seam to additional pre-determined amounts until the Pittsburgh Seam is moved to its final closing position. Each substantially V-shaped roller member contributes to the closing of the Pittsburgh Seam regardless of the orientation of the male and female portions of the Pittsburgh Seam, each substantially V-shaped seam forming member initially closing the Pittsburgh Seam a predetermined amount such that the last substantially V-shaped seam forming member associated with the plurality of substantially V-shaped seam forming members completes the closing of the Pittsburgh Seam.

Still further, it is also recognized that the plurality of seam forming members housed within a particular carriage assembly can be arranged such that the carriage assembly can completely close a Pittsburgh Seam when the carriage assembly moves either upwardly from its first position to its second position as previously explained, or also when the carriage assembly moves in a downward direction from its second position to its first position as likewise previously explained. Depending on how the particular plurality of seam forming members are arranged within a particular carriage assembly will dictate whether the carriage assembly will close a Pittsburgh Seam in a single pass in either direction of travel.

It is also recognized that the various systems associated with the present Pittsburgh Seam closing apparatus can be computer controlled and programmed such that movement of the various clamping assemblies and seam forming carriage assemblies will automatically take place upon proper positioning of the duct section within the apparatus, or upon activation of a start switch. It is also recognized that each step of the seam closing process can likewise be manually operated from a control panel associated with the present apparatus.

Because an operator does not need to orient the duct section to be seamed at a particular orientation, the present apparatus not only saves time and is more cost efficient with respect to orienting a duct section on the apparatus for a seaming operation, but it also saves substantial time and labor during the duct forming and assembly process when a pre-assembled duct section is formed and moved to the seam closing apparatus. The present apparatus likewise substantially eliminates improper closing of the Pittsburgh Seam due to improper orientation of the seam in a particular seaming device and it likewise reduces the number of rejects. The present apparatus therefore greatly improves the seam closing process and enables an operator to easily and quickly position a duct section on the present apparatus regardless of the orientation of the Pittsburgh Seam relative to the seam forming carriage assembly; it enables an operator to easily and quickly adjust the apparatus to accommodate duct sections of any length; and it substantially eliminates waves or wrinkles in the duct seam.

These and other aspects and advantages of the present vertical Pittsburgh Seam closing apparatus will become apparent to those skilled in the art after considering the following detailed description in connection with the accompanying drawings.

DETAILED DESCRIPTION

Figure 1:
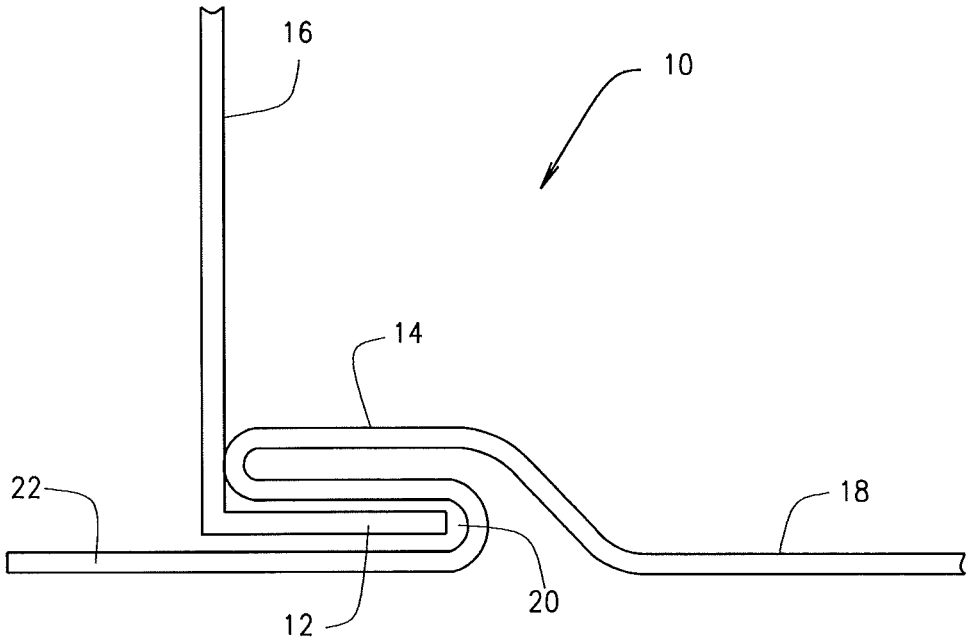
FIG. 1 is a partial side elevational view illustrating a standard Pittsburgh Seam prior to closing.

Referring to the drawings more particularly by reference numbers wherein like numerals refer to like parts, number 10 in FIG. 1 illustrates a standard Pittsburgh Seam having a male portion 12 and a female portion 14. The male portion 12 of the Pittsburgh Seam 10 is associated with one longitudinal edge of the sheet metal portion 16 forming one side of a typical duct section and the female portion 14 is associated with one longitudinal edge of another sheet metal portion 18 forming another side of a typical duct section. The male portion 12 is formed by bending the entire longitudinal edge of sheet metal portion 16 inwardly at approximately a right angle as illustrated in FIG. 1. The female portion 14 of the Pittsburgh Seam 10 includes a groove or slot 20 for receiving the male portion 12. The female groove 20 is formed by bending the entire longitudinal edge of sheet metal portion 18 into a Z-shaped or S-shaped bend as illustrated in FIG. 1. The female groove or slot 20 is formed as part of the Z-shaped or S-shaped bend and includes an overhanging edge portion 22 which extends beyond the partially formed seam when the male portion 12 is positioned within the female cavity 20. The overhanging edge portion 22 extends beyond sheet metal portion 16 and is designed to be bent inwardly so that it lies adjacent to sheet metal portion 16 when the seam 10 is closed and locked. The Pittsburgh Seam 10 illustrated in FIG. 1 is engaged but is not closed and locked. Bending of the overhanging edge portion 22 is required, either manually or through mechanical means, in order to close and lock the seam and the corresponding abutting sheet metal portions in order to form the duct section. When fully closed, the overhanging edge portion 22 will lie against and abut the outer surface of sheet metal portion 16.

Figure 2:
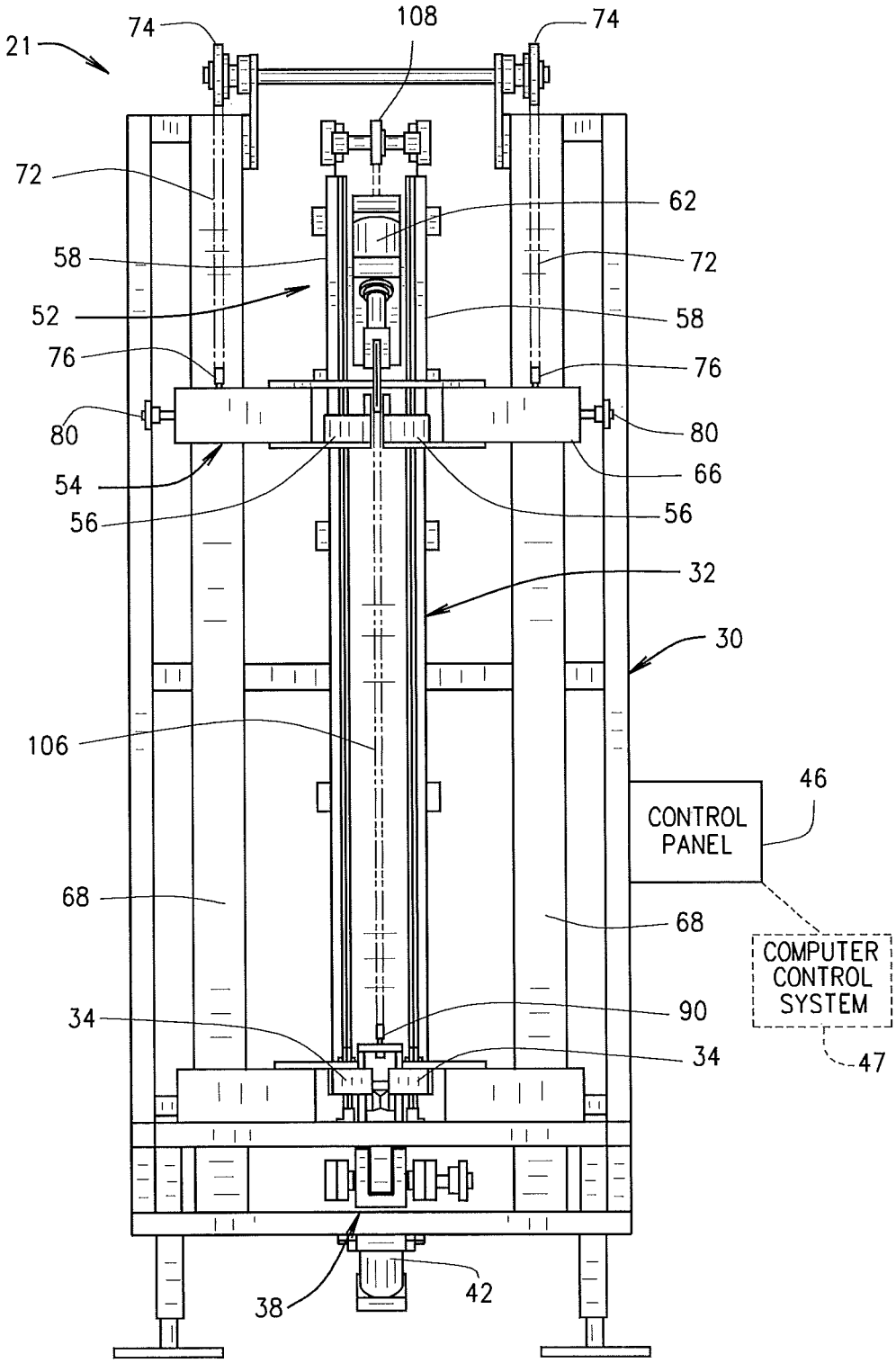
FIG. 2 is a front elevational view of a vertical Pittsburgh Seam closing apparatus constructed in accordance with the teachings of the present invention.
Figure 3:
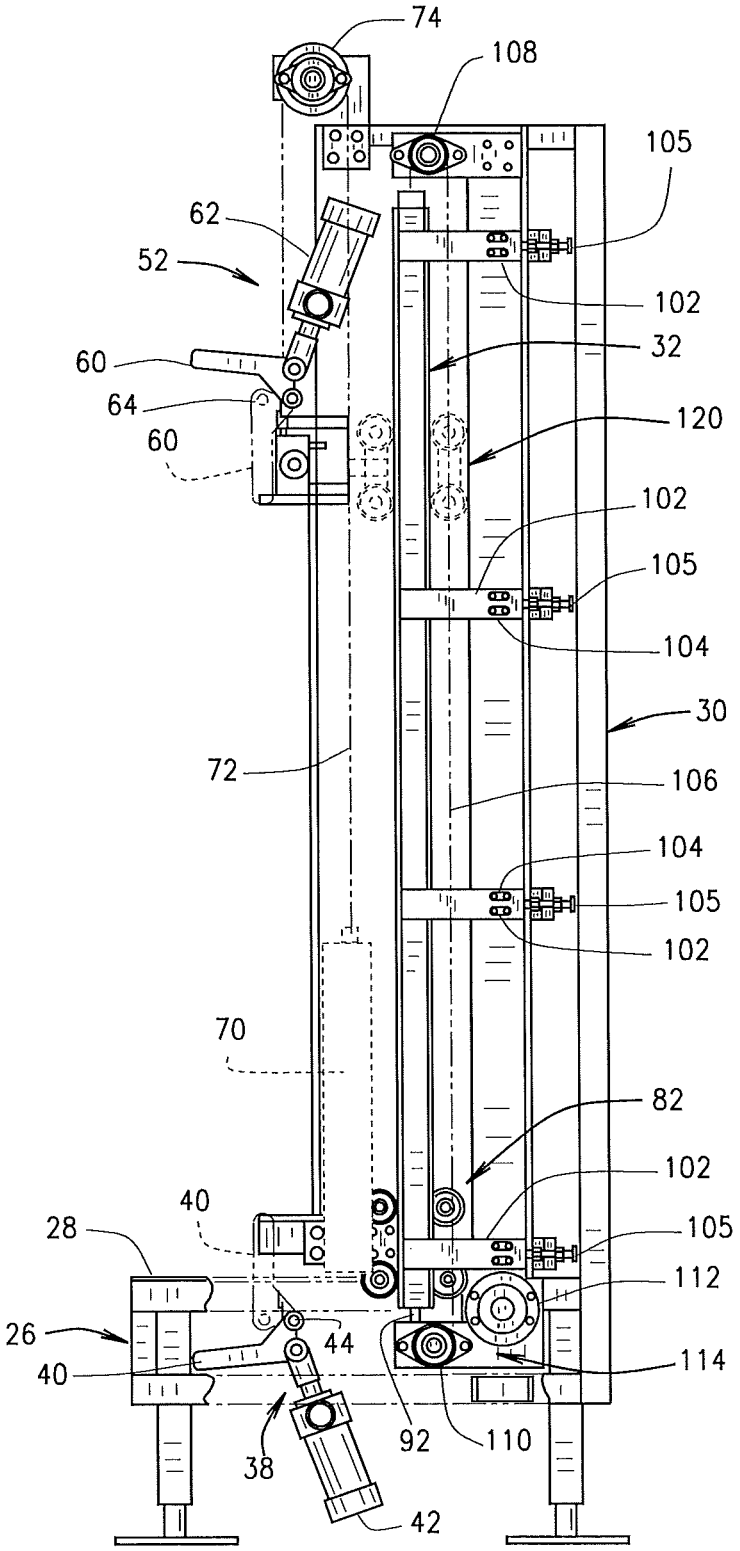
FIG. 3 is a side elevational view of the apparatus of FIG. 2.

FIGS. 2-10 illustrated one embodiment of a Pittsburgh Seam closing apparatus 24 constructed according to the teachings of the present invention. As best illustrated in FIGS. 2 and 3, the present apparatus includes a base member 26 having a supporting surface 28 associated therewith for positioning and locating thereon a duct section having a Pittsburgh Seam to be closed as will be hereinafter further explained. A suitable support framework structure 30 is fixedly attached to the base member 26 and includes a vertical track mechanism 32 for supporting and guiding movement of a seam forming roller carriage assembly 82 therealong for closing a Pittsburgh Seam as will be hereinafter further explained. The carriage assembly 82 includes the seam forming assembly 84 which is used to bend and close the Pittsburgh Seam 10.

Figure 4:
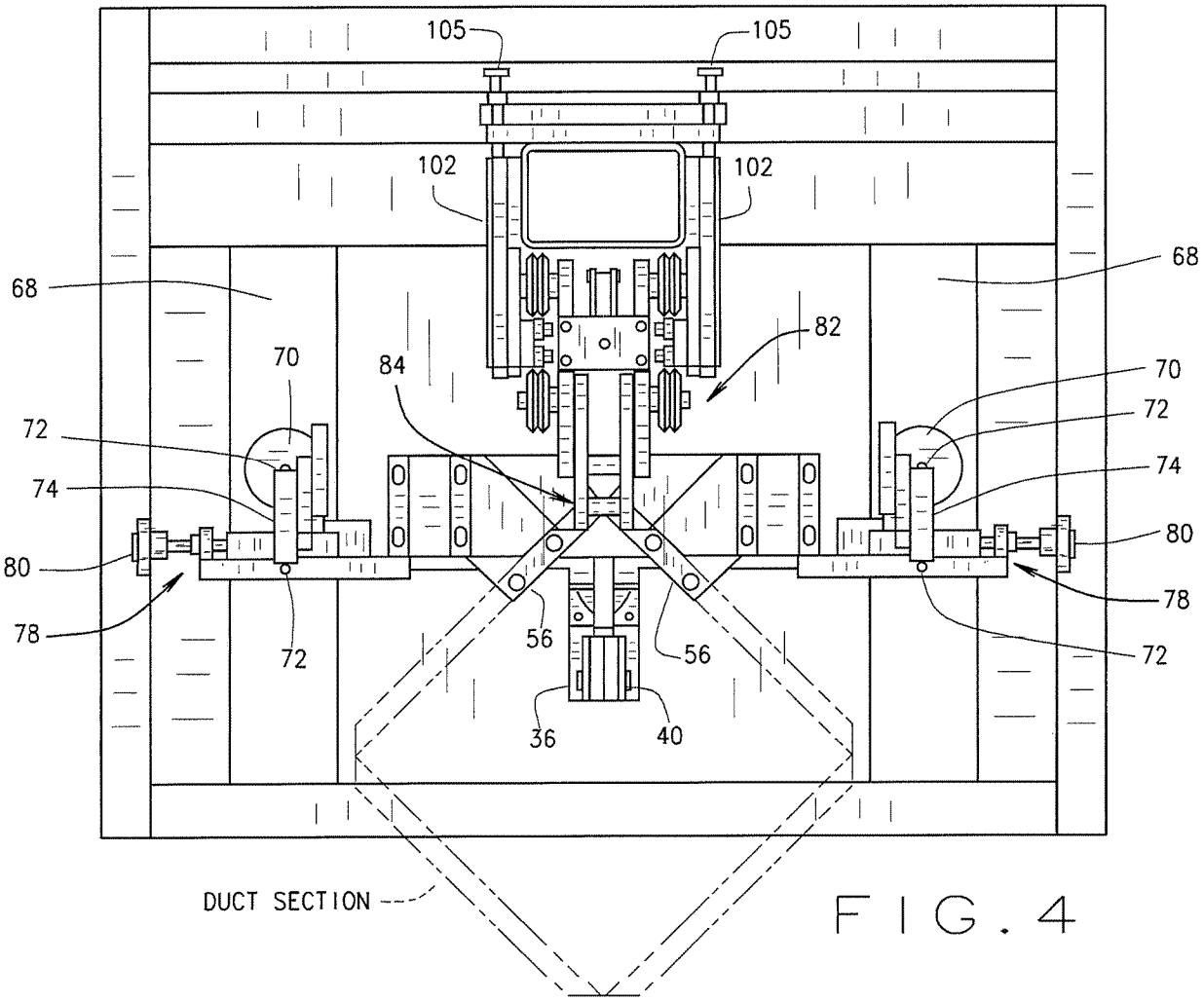
FIG. 4 is a partial top plan form view of the apparatus of FIGS. 2 and 3.
Figure 5:
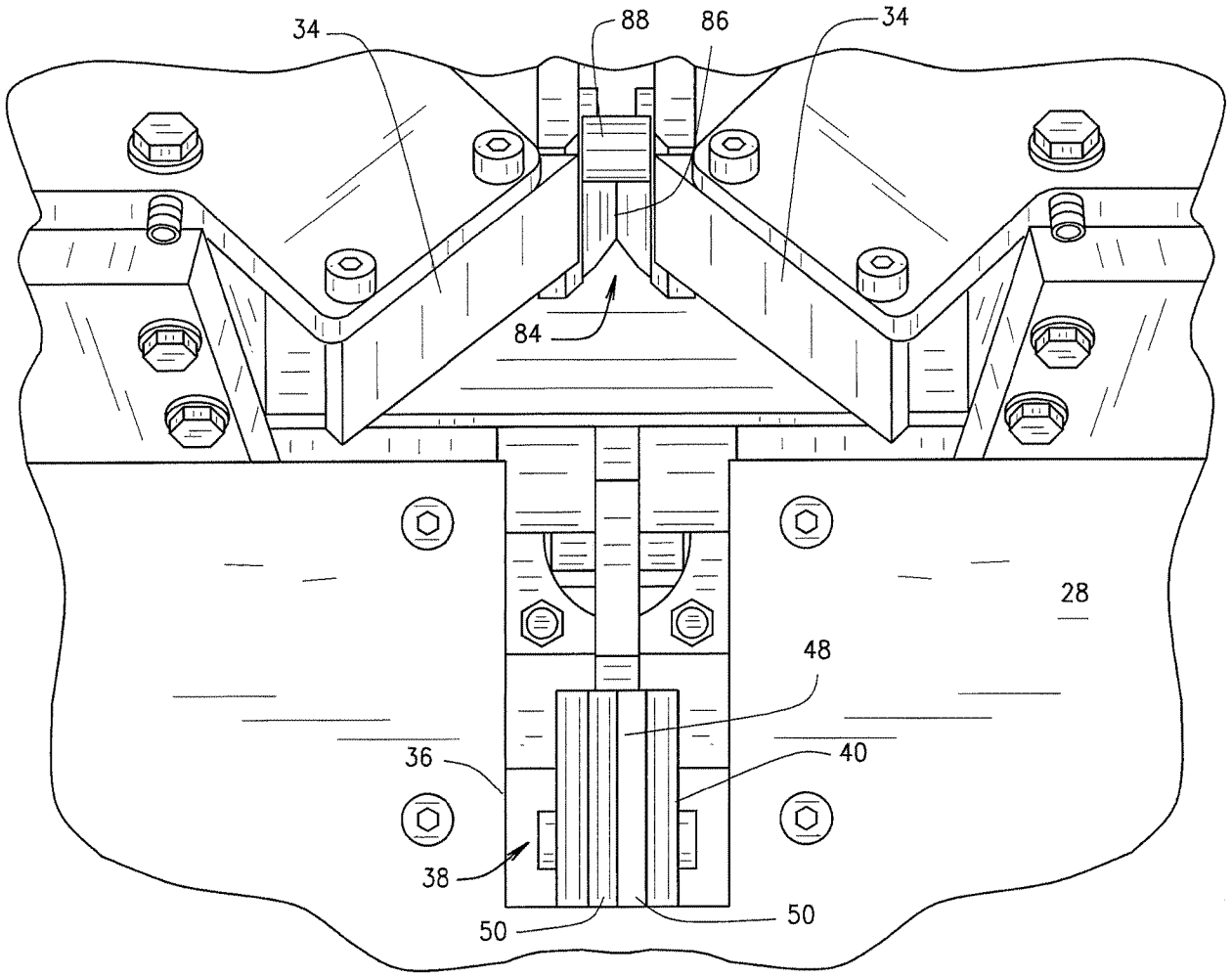
FIG. 5 is a partial perspective view of the lower V-shaped guide members, the lower clamp head assembly, and the seam forming assembly constructed in accordance with the teachings of one embodiment of the present invention.

The base member 26 includes a pair of lower guide members or clamp pads 34 positioned in spaced apart relationship relative to each other so as to form a "V" for guiding the duct section and its associated Pittsburgh Seam into proper positioning on the base member support surface 28 as best illustrated in FIGS. 4 and 5. FIG. 4 shows a typical duct section engaged with the upper guide members 56 as will be hereinafter further explained. Engagement of upper guide members 56 with a typical duct section in substantially identical to the engagement of lower guide members 34 with a typical duct section. The lower guide members 34 form a lower guide assembly and the members 34 are arranged at approximately a right angle to each other to receive a corner of a typical duct section. The V-shaped lower guide members 34 are fixedly attached to base member 26 and are adjustable in a conventional manner such as through the use of a screw and slot arrangement so as to ensure that the duct section is properly oriented relative to the seam forming assembly 84 as will be hereinafter described. In this regard, the V-shaped guide members 34 are positioned and located such that the seam forming assembly 84 associated with the carriage assembly 82 is positioned therebetween and such that the V-shaped lower guide members 34 and the initial positioning of the seam forming assembly 84 are located adjacent base member supporting surface 28 as best illustrated in FIG. 5. The V-shaped guide members 34 allow the duct section corner to be pressed into an interference fit with the seam forming assembly 84 and also provide proper orientation of the duct section relative to the assembly 84 as will be hereinafter further explained.

Figure 5A:
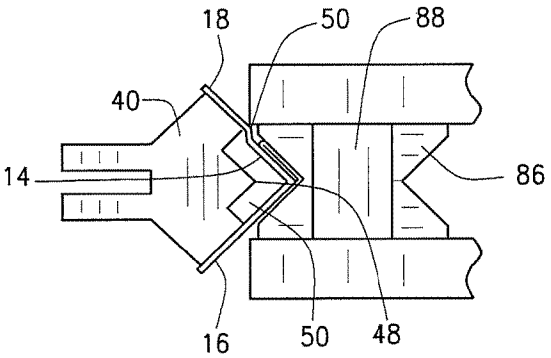
FIG. 5A is a top plan form view showing the lower clamping member in its clamped position inside a typical duct section and adjacent the inside portion of a typical Pittsburgh Seam.

The base member 26 further includes an elongated slot or opening 36 associated with its support surface 28 for receiving a lower clamp head assembly 38 as best illustrated in FIG. 5. The elongated opening 36 is positioned and located in alignment with the seam forming assembly 84 and allows the clamping member 40 associated with the lower clamp head assembly 38 to be pivotally rotatable between an unclamped positioned wherein the clamping member 40 is recessed within the elongated opening 36 as illustrated in solid outline form in FIG. 3 and a clamping position where the clamping member 40 is moved to a vertical upright position as illustrated in dotted outline form in FIG. 3 so as to be positioned inside the duct section and adjacent the inside portion of the Pittsburgh Seam to be closed. As best illustrated in FIGS. 4 and 5A, when a duct section is positioned between the lower V-shaped guide members 34, the elongated opening 36 and the lower clamping member 40 recessed therein is located inside the duct section positioned thereover. In this regard, as best illustrated in FIG. 3, when in its unclamped position, the lower clamp member 40 can be located anywhere below the supporting surface 28 so as not to interfere with the placement and positioning of a duct section on the supporting surface 28 and between the lower guide members 34. As best illustrated in FIG. 3, the lower clamp head assembly 38 includes a clamp actuating cylinder 42 which is connected to clamping member 40 for pivotally rotating the clamping member about pivot axis 44. Rotation of the clamping member 40 about pivot axis 44 pivotally moves the clamping member 40 between its clamped and unclamped positions. The actuating cylinder 42 can be either hydraulically or pneumatically controlled from a control panel 46 (FIG. 2) associated with the present apparatus. It is also recognized and anticipated that the actuating cylinder 42 can be replaced with an electronically activated solenoid actuator or other suitable activator means. Movement of the actuating cylinder 42 and the relative positioning of the clamping member 40 is illustrated in FIGS. 2 and 5A.

The clamping member 40 includes a specially configured mating surface as best illustrated in FIGS. 5 and 5A for improving the clamping connection between the inside portion of the Pittsburgh Seam 10 (FIG. 1) and the clamping member 40. In this regard, the mating surface of the clamping member 40 includes an edge portion 48 positioned and located in alignment with the corner of the duct section and the corner of the Pittsburgh Seam 10 when the clamping member is moved to its clamping position. A notched portion 50 is located on either side of the edge portion 48 and is shaped and configured so as to make clearance for and receive the Z-shaped or S-shaped female portion 14 of the Pittsburgh Seam when the clamping member 40 is in its clamped position as shown in FIG. 5A. Depending upon which side of the duct section corner the female portion 14 of the Pittsburgh Seam lies, one of the notched portions 50 of the clamping member 40 will allow for and receive the female portion 14. As a result, orientation of the female portion 14 of the Pittsburgh Seam 10 when positioned between the lower guide members 34 is not critical since the female portion 14 will be located on either the left or right side of the seam and one of the notched portions 50 will receive the female portion 14. This configuration therefore enables the clamping member 40 to properly engage and support the inside portion of the Pittsburgh Seam 10 regardless of the orientation of the seam and regardless of which side of the seam the female portion 14 is located. Still further, this configuration likewise provides additional support to the female portion of the seam at the point of clamping since one of the notched portions 50 will be in close relationship with the female portion 14 of the Pittsburgh Seam 10 thereby substantially preventing movement of the duct section and seam relative to the clamping member 40 during the closing process.

A similarly constructed upper clamp head assembly 52 is mounted on a selectively movable and adjustable assembly 54 such that the entire upper clamp head assembly 52 can be moved and adjusted to accommodate any duct section length as best illustrated in FIG. 2. The upper clamp head assembly 52 likewise includes a pair of V-shaped upper guide members 56 forming an upper guide assembly which is positioned in vertical alignment with the lower guide members 34 for likewise guiding the upper portion of the duct section into proper position on the present apparatus 24 as best illustrated in FIG. 4. The upper V-shaped guide members 56 are likewise fixedly attached to assembly 54 and are likewise adjustable in a conventional manner as previously explained with respect to the lower guide members 34. The upper clamp head assembly 52 is mounted to assembly 54 through the use of plate members 58 and other supporting structure and likewise includes an upper clamping member 60 which is pivotally movable similar to the lower clamping member 40 through the use of an actuating cylinder 62 (FIG. 3) which can be likewise controlled from control panel 46. Like clamp actuating cylinder 42, actuating cylinder 62 is connected to clamping member 60 for pivotally rotating the clamping member 60 about pivot axis 64. The upper clamping member 60 is substantially identical in shape and configuration to lower clamping member 40 and is likewise pivotally rotatable between an unclamped position as illustrated in solid outline form in FIG. 3 and a clamping position wherein the clamping member 60 is again positioned inside the duct section and adjacent the inside portion of the Pittsburgh Seam 10 to be closed as illustrated in dotted outline form in FIG. 3. The actuating cylinder 62 can likewise be electrically, hydraulically or pneumatically controlled from control panel 46 and once a particular duct section is positioned within both the lower and upper guide members 34 and 56 respectively, and once the lower and upper clamping members 40 and 60 respectively are moved to their clamping positions, the duct section is properly oriented and positioned on the present apparatus 24 and is ready for operative sealing of the Pittsburgh Seam 10. In addition, like clamping member 40, the mating portion of clamp member 60 with the inside portion of the Pittsburgh Seam 10 is likewise specially configured as discussed with respect to clamping member 40 to include an edge portion 48 and corresponding notched portions 50 so as to enable the upper clamping member 60 to likewise properly receive and support the inside portion of the Pittsburgh Seam regardless of the orientation of the female portion 14 of the Pittsburgh Seam 10 as illustrated in FIG. 5A.

The upper clamp head assembly 52, as discussed, is mounted on a selectively movable assembly 54 which includes horizontal support member 66 which is vertically movable along the entire length of the pair of upright support members 68 as best illustrated in FIG. 2. Vertical support members 68 are at least partially hollow and each includes a counter balance weight 70 which is attached to a respective chain or other suspension mechanism 72 (FIGS. 2 and 3). Chain mechanism 72 has one end portion attached to a respective counter balance weight 70 and is fed over a respective idler assembly 74 so as to have its opposite end portion attached to a respective attachment point 76 associated with support member 66. As best illustrated in FIG. 2, a pair of attachment points 76 are associated with support member 66 and are positioned and located at a location in alignment with the upright support members 68. The opposite end portions of support member 66 each include a releasable holding and clamping mechanism 78 as best illustrated in FIG. 4 for releasably holding the support member 66 and the entire movable assembly 54 at a fixed vertical location along the length of vertical support members 68.

As illustrated in FIG. 4, one embodiment of a releasable clamping and holding mechanism 78 can take the form of a threaded screw or pin member 80 which can be selectively releasably tightened against the respective vertical support members 68 or other structure associated with assembly 54 for holding each opposite side of support member 66 at a fixed vertical position along the length of the support members 68. Likewise, releasing the threaded members 80 by simply unthreading such members will allow the support member 66 to move and slide vertically along the entire length of the vertical support members 68 so that an operator can adjust the member 66 and its associated upper guide members 56 relative to the top portion of a particular duct section to be seamed based upon its particular length. The counter balance weights 70 are appropriately weighted based upon the weight of the entire upper clamp head assembly 52 and its associated assembly 54 such that a single operator can easily move support member 66 along the members 68 once the clamping mechanisms 78 are released. This enables an operator to quickly and easily move and adjust the upper clamp head assembly 52 and the upper guide members 56 which are associated therewith so as to accommodate duct sections of any length within the overall length of vertical support members 68.

Once the particular duct section is properly positioned on supporting surface 28 and within the lower guide members 34, the upper clamp head assembly 52 can be adjusted so as to move the upper guide members 56 into contact with the upper end portion of the particular duct section to be seamed and the support members 66 and assembly 54 can then be clamped and secured at that vertical location through the use of the clamping mechanism 78. Once the upper clamp head assembly 52 is properly positioned and oriented relative to the top portion of the duct section to be closed, the upper clamping member 60 can be moved to its clamping position. It is recognized and anticipated that any counter balance weight type arrangement and suspension mechanism can be utilized to allow a single operator to easily and quickly adjust the upper clamp head assembly 52 to accommodate any length of duct section including non-standard and odd sized duct sections. It is also recognized and anticipated that any type of selectively releasable clamping system such as clamping system 78 can be utilized to easily lock and unlock support member 66 along the length of vertical support members 68, and it is recognized and anticipated that any type of guide or tracking system for allowing support member 66 to slidably move along the length of vertical support members 68 can likewise be utilized without departing from the spirit and scope of the present invention.

Figure 7:
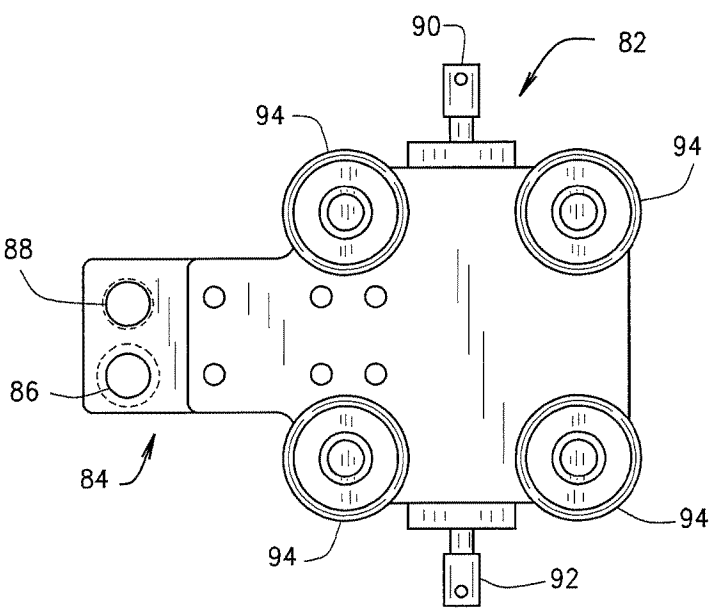
FIG. 7 is a side elevational view of the carriage assembly of FIG. 6.
Figure 6:
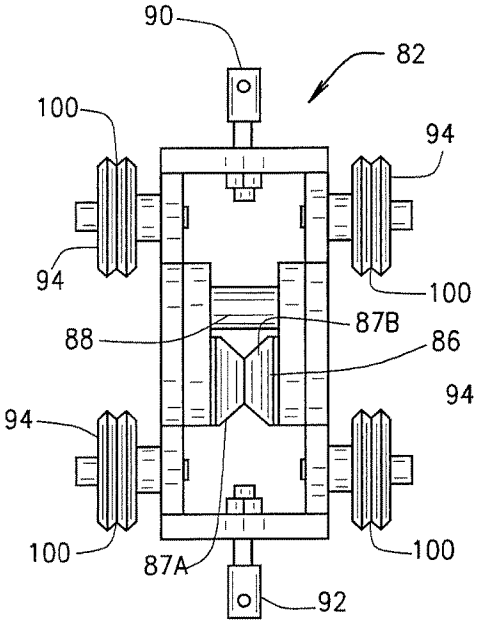
FIG. 6 is a front elevational view of one embodiment of a seam forming carriage assembly constructed in accordance with the teachings of the present invention.
Figure 8:
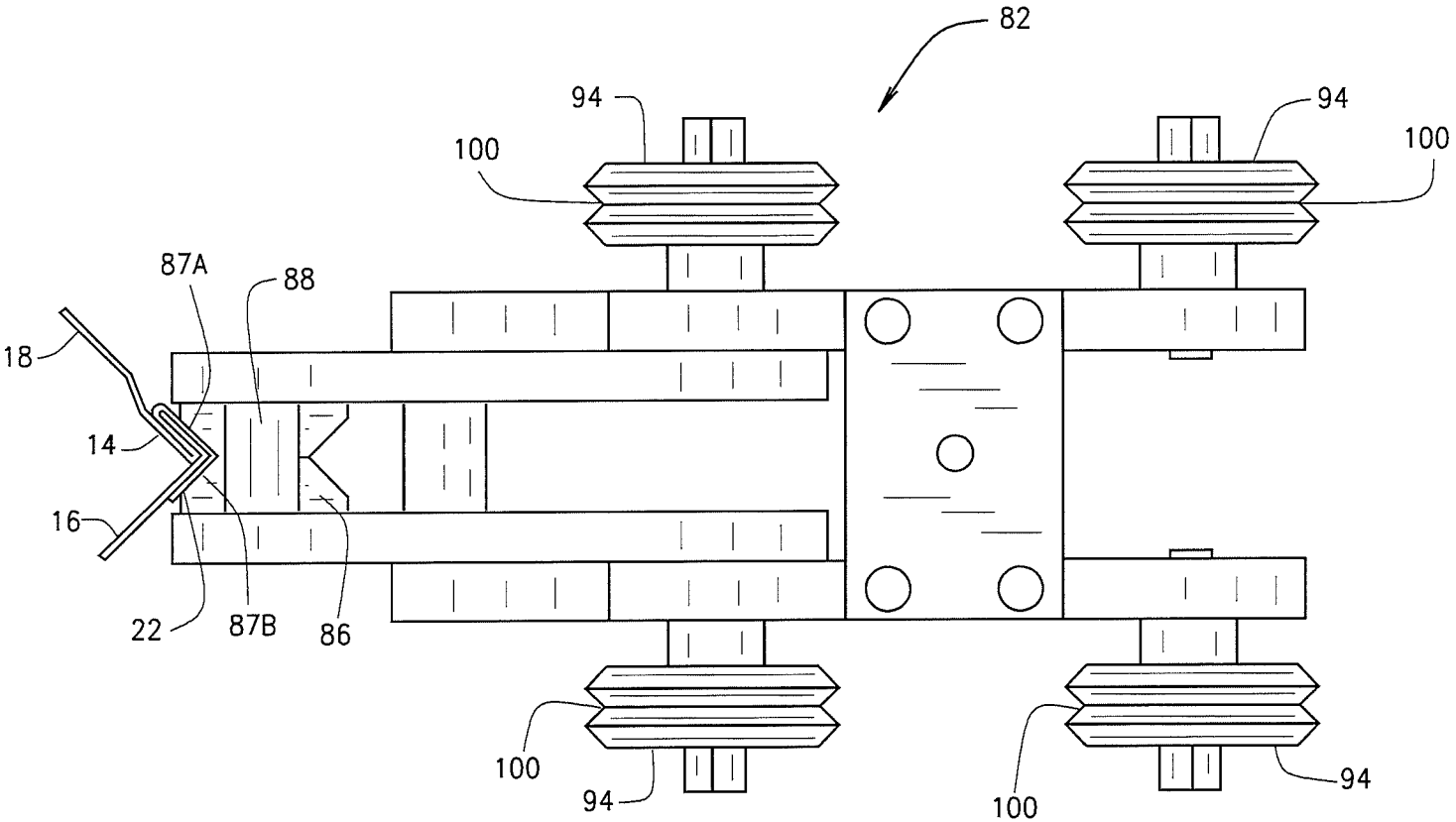
FIG. 8 is a top plan form view of the carriage assembly illustrated in FIGS. 6 and 7 showing a typical Pittsburgh Seam engaged with the roller assembly after the seam has been closed.

FIGS. 6 and 7 illustrate one embodiment of a carriage system 82 which includes one embodiment of the present seam forming assembly 84. The embodiment illustrated in FIGS. 6 and 7 includes an assembly 84 having a pair of roller members 86 and 88 mounted in vertical arrangement relative to each other (FIG. 6), the lower roller member 86 being substantially V-shaped in configuration and the upper roller member 88 being substantially cylindrical in shape. The V-shaped roller member 86 enables the Pittsburgh Seam 10 to be positioned within the lower and upper guide members 40 and 60 in any of the two possible orientations discussed above, namely, with the female portion 14 of the Pittsburgh Seam 10 located on either side of the seam corner as illustrated in FIGS. 5A and 8 as will be hereinafter further explained. Both seam forming roller members 86 and 88 are positioned on the movable carriage assembly 82 which is guided on a vertical track system 32 through the use of a chain and sprocket type assembly which is powered in a conventional manner through the use of a drive motor 112 (FIG. 3) as will be hereinafter explained. The seam forming carriage assembly 82 includes a pair of chain attachment pins 90 and 92 (FIG. 7) and a plurality of guide wheels 94. In the particular embodiment illustrated in FIGS. 3, 4, 6 and 7, the carriage assembly 82 includes eight guide wheels 94.

Figure 9:
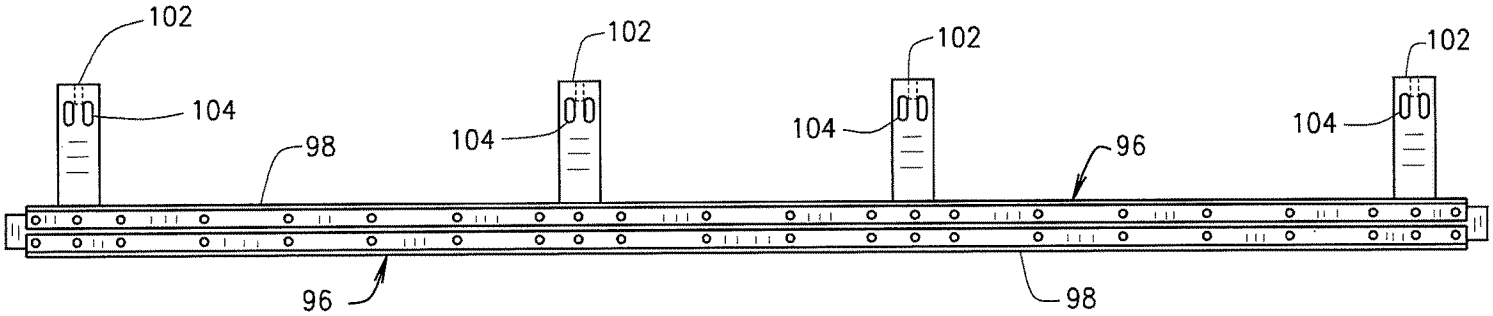
FIG. 9 is a side elevational view of one embodiment of a track system constructed in accordance with the teachings of the present invention.
Figure 10:
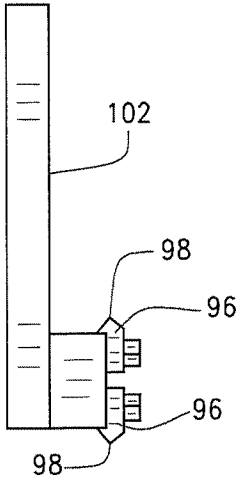
FIG. 10 is a top plan form view of the track system of FIG. 9.

Each guide wheel 94 associated with carriage assembly 82 is positioned and located to track and guide along a vertical track mechanism 32 which includes a pair of track members 96 as best illustrated in FIG. 9, each track member 96 having an edge portion 98 as best illustrated in FIG. 10 which is configured to mate with a corresponding groove 100 associated with each guide wheel 94 (FIGS. 6 and 8). Track edge portion 98 is illustrated as being pointed or wedge shaped so as to be cooperatively received and engaged within the corresponding groove 100 associated with each guide wheel 94. In this regard, it is recognized and anticipated that the groove 100 could be associated with each respective track 96 and that the wedge shaped or pointed edge portion 98 could be associated with each respective guide wheel 94. It is also recognized and anticipated that other corresponding shapes and configurations for holding the guide wheels in positive mating relationship with the tracks 96 could likewise be utilized in the present invention. The track members 96 are likewise adjustable fore and aft relative to the lower and upper guide plates 34 and 56 through the use of a plurality of adjustable bolt plates 102 to which the tracks 96 are fixedly attached as best illustrated in FIGS. 3 and 9. Attachment plates 102 include a plurality of elongated slots 104 which enable the respective plate members 104 to be moved horizontally fore and aft so as to change the position of the assembly 84 and its corresponding roller members 86 and 88 relative to the Pittsburgh Seam to be closed. This adjustability can be accomplished by any suitable adjustment means such as through the use of adjustment pins 105 (FIGS. 3 and 4) and allows an operator to increase or decrease the force applied and interference between the seam forming roller members 86 and 88 and the Pittsburgh Seam associated with the duct section clamped into position on the present apparatus 24.

As best illustrated in FIGS. 2 and 3, a chain member or other suspension member 106 has one end portion attached to the adjustment pin 90 associated with carriage 82 and has its opposite end portion attached to adjustment pin 92 associated with the opposite end portion of carriage assembly 82. Chain member 106 is fed over and traverses idler assembly 108 and is driven by transfer shaft member 110 as best illustrated in FIG. 3. Transfer shaft member 110 is driven by drive motor 112 and an associated chain and sprocket mechanism 114 associated with drive motor 112 and transfer shaft 110 (FIG. 3). Drive motor 112 through the mechanism 114 will move and rotate transfer shaft member 110 in either a clockwise or counterclockwise direction which in turn will move chain member 106 about idler assembly 108 so that the entire carriage assembly 82 can be moved up and down vertical track mechanism 32. It is recognized and anticipated that any drive mechanism and any sprocket/idler arrangement can be used to move the seam forming carriage assembly 82 vertically along track mechanism 32. Activation of the drive motor 112 and movement of the carriage assembly 82 can be activated by an operator through the control panel 46.

When activated, the carriage assembly 82 carrying the seam forming roller assembly 84 moves in a vertical direction from its lower start position adjacent the lower guide members 34 as illustrated in FIGS. 2 and 3 to an upper position determined by the positioning and location of the upper clamp head assembly 52 and support member 66. As the seam forming assembly 84 moves in an upward direction, the substantially cylindrically shaped roller member 88 initially bends the overhanging seam edge portion 22 approximately 45° and then the bottom V-shaped roller member 86 completes the closing of the seam and moves the overhanging edge portion 22 into a tight abutting relationship with the outer surface of the duct section such as duct section 16 illustrated in FIGS. 1 and 8. Because of its V-shaped configuration, one side of the V-shaped roller member 86 such as side portion 87A will overlay and lie in engagement with the female portion 14 of a typical Pittsburgh Seam 10 and one side of the V-shaped roller member 86 such as side portion 87B will overlay the opposite side of the Pittsburgh Seam 10 as best illustrated in FIG. 8. In this regard, FIG. 8 shows a typical Pittsburgh Seam 10 positioned within the V-shaped roller member 86 after the overhanging edge portion 22 has been closed and moved adjacent to the outer surface of duct section 16.

It is important to note that the side of the V-shaped roller member 86 not being used to form or close the seam, for example, side portion 87A adjacent the female portion 14, holds one side of the duct section and supports that side of the duct section so that the opposite side of the roller member 86, namely, side portion 87B, presses against the overhanging edge portion 22 to create the bending or forming force. In other words, one side of the V-shaped roller member 86, such as side portion 87A, holds the duct section in proper position while the other side of the V-shaped roller member, such as side portion 87B, actually bends the overhanging edge portion 22 into its closed position. As a result, it makes no difference if the overhanging edge portion of a typical Pittsburgh Seam 10 extends in a direction corresponding to either side 87A or 87B of the V-shaped roller member 86 since one side of the roller member 86 will bend the Pittsburgh Seam while the other side will provide sufficient support and force for completing the bending or forming action along the entire length of the seam. Since the carriage assembly 82 moves upwardly from its lower start position as illustrated in FIGS. 2 and 3 along the entire length of the duct section and associated Pittsburgh Seam to be closed, the V-shaped roller member 86 supports the closing seam along its entire length. This is a substantial improvement over known existing Pittsburgh Seam closing apparatus which typically do not provide adequate support for closing the seam along the entire length of the seam.

When the seam forming assembly 84 reaches the upper clamping member 60 which holds the top portion of the duct section and the associated Pittsburgh Seam to be closed in proper position on the present apparatus 24, the carriage assembly 82 is returned to its lower start position and again traverses the full length of the seam. During this return run, the seam forming assembly 84 will re-form the metal of the Pittsburgh Seam which was closed during its upward travel, if necessary, so as to remove any waves or wrinkles in the duct section. Because the V-shaped roller member 86 presses and supports the Pittsburgh Seam on all sides of the seam during the closing process along the entire length of the seam to be closed, any waves or wrinkles in the edge being seamed are removed by the reformation of the material which results in a smooth and attractive seam. If any waves or wrinkles do occur, the reverse travel of the roller assembly 84 will again re-form the metal of the seam so as to remove any such waves or wrinkles. Once the seam has been closed and the carriage assembly 82 has been returned to its initial lower position adjacent base supporting surface 28, the lower and upper clamp head assemblies 38 and 52 are moved to their unclamped position, and the duct section can be removed and/or rotated so that another seam can be positioned on the present apparatus 24 for closure.

Due to the position of the roller member 88 on top of roller member 86, initial peening of both opposite ends of the Pittsburgh Seam to be closed is still required. This initial peening on the end of the seam to be positioned adjacent the lower guide members 34 should be over a length not substantially greater than the diameter of the V-shaped roller member 86 whereas the initial peening of the opposite end of the seam to be positioned adjacent the upper guide numbers 56 may be over a length slightly greater than the lower end since roller member 86 will lie below roller member 88 at the top of its travel along track system 32. This initial peening of the respective starting ends of each Pittsburgh Seam to be closed also preliminarily holds the duct portions together prior to positioning a particular duct section on supporting surface 28.

Figure 12:
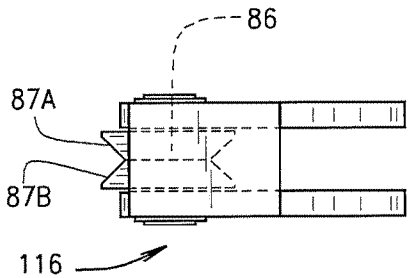
FIG. 12 is a top plan form view of the roller assembly of FIG. 11.
Figure 11:
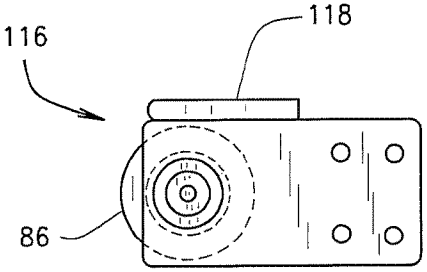
FIG. 11 is a side elevational view of another embodiment of a seam forming assembly constructed in accordance with the teachings of the present invention.

FIGS. 11 and 12 illustrate another embodiment 116 of the present seam forming assembly wherein the top substantially cylindrical roller member 88 associated with assembly 84 is replaced with a flat plate or wiper block 118 which is positioned and located above the V-shaped roller member 86 to again bend the overhanging edge portion 22 of a typical Pittsburgh Seam 10 at least approximately 45° as previously explained with respect to embodiment 84. In all other respects, the seam forming assembly 116 is substantially identical to and functions substantially similar to seam forming assembly 84. In addition, the flat plate or wiper block 118 can likewise be replaced with any object which is shaped and configured so as to bend the overhanging edge portion 22 of a typical Pittsburgh Seam 10 as previously explained. Any object and any configuration of such object which will achieve bending of the overhanging edge portion 22 to approximately a 45° angle will achieve the stated purpose and will allow the V-shaped forming roller 86 to complete the seaming process.

In still another embodiment of the present vertical Pittsburgh Seam closure apparatus, a second seam forming carriage assembly similar to carriage assembly 82 such as carriage assembly 120 illustrated in dotted outline form in FIG. 3 can be positioned adjacent the upper guide members 56 in a substantially similar arrangement as disclosed with respect to lower guide members 34 and seam forming assembly 84. In this embodiment, the second or upper seam forming carriage assembly 120 can be operable independent of the lower seam forming carriage assembly 82 such that a dual carriage system can be achieved. Each carriage system would have its own seam forming assembly associated therewith such as seam forming assembly 84 and each carriage assembly would traverse only a portion of the full length of the Pittsburgh Seam to be closed. In this particular embodiment, the lower seam forming carriage assembly such as carriage assembly 82 can be moved upwardly so as to traverse the vertical track mechanism 32 a distance less than the full length of the duct section to be seamed and the upper seam forming carriage assembly such as carriage assembly 120 can be moved downwardly so as to traverse the track mechanism 32 a distance less than the full length of the duct section to be seamed, this downward travel distance of the second carriage assembly overhanging at least a portion of the seaming process accomplished by the lower carriage assembly 82 so as to ensure complete seaming of the Pittsburgh Seam to be closed. In this embodiment, it is envisioned that the lower carriage assembly 82 would operate independently and would move upward along the vertical track mechanism 32 to a predetermined height along the length of the seam to be closed and once reaching its predetermined height, the lower carriage assembly 82 would return to its initial start position. During the return travel of the lower carriage assembly, or once the lower carriage assembly reaches its initial start position, movement of the second upper carriage assembly 120 can occur. In similar fashion, the upper carriage assembly will move downwardly along the vertical track mechanism 32 to a predetermined location along the length of the seam to be closed, such predetermined location including some overlap with the distance traversed by the lower carriage assembly 82. When both carriage systems return to their initial start position, the seaming process is completed.

The timing of the independent movement of the dual carriage system can be computer controlled or manually controlled through control panel 46. The configuration of the upper carriage assembly 120 will be substantially identical to the lower carriage assembly 82 and lower seam forming assembly 84 as previously described except that the V-shaped roller member such as roller member 86 will be positioned above roller member 88 or plate member 118 thereby allowing the seam forming assembly to be positioned closer to the terminal end of the seam to be closed at its upper end portion. This results in less peening of that particular seam end portion as compared to the embodiment where a single seam forming carriage assembly 82 is utilized.

The second or upper carriage assembly 120 will move on the same track system 32 as lower carriage assembly 82 via a substantially similar chain and sprocket assembly as described with respect to carriage assembly 82. In this regard, a separate and independent drive motor and chain and sprocket assembly can be utilized to drive the second upper carriage assembly 120 and such chain and sprocket assembly can be positioned in parallel relationship to chain mechanism 106. Various portions of the upper carriage assembly may be configured slightly differently as compared to the lower carriage assembly 82 such as the location and structure associated with the chain attachment pin members 90 and 92 so as to accommodate a parallel chain or suspension mechanism. It is likewise recognized and anticipated that still other means for moving the second carriage assembly on the same track mechanism 32 as the lower carriage assembly 82 can be utilized and are envisioned without departing from the spirit and scope of the present invention.

It is also recognized that the various systems associated with the present apparatus 24 such as moving the clamping members 40 and 60 between their unclamped and clamped positions and moving the lower carriage assembly 82 and/or the upper carriage assembly 120 along track mechanism 32 can be computer controlled and programmed such as through a computer control system 47 (FIG. 2) coupled to the present apparatus 24 such as through control panel 46 such that movement of these assemblies will automatically take place upon proper positioning of the duct section within the guide members 34 and 56, or upon activation of a start switch associated with control panel 46. It is also recognized that each step of the seam closing process can likewise be manually operated by a single operator from control panel 46. In this regard, appropriate switches and valves for operating the actuators 42 and 62 and the drive motor 112 can be controlled independently from control panel 46. It is also recognized that movement of the lower carriage assembly 82 and/or an upper carriage assembly 120 can be controlled by a manual switch associated with control panel 46 and reversing of the lower carriage assembly 82 and/or the upper carriage assembly can be controlled either manually through control panel 46 or mechanically through the use of appropriate sensors and/or contact switches for stopping movement in one direction and starting movement in the reverse direction. Still other fully automated and/or partially automated control systems for operating the present apparatus 24 are likewise recognized and anticipated.

It is also important to note that the forming roller members 86 and 88 are on shaft portions which have diameters substantially larger than shafts typically associated with the industry standard, and typically associated with the roll forming members associated with known seam closing devices. In many instances, the known roller members are associated with small threaded camshafts which are subject to easy breaking due to the forces generated during the Pittsburgh Seam closing process. As illustrated in FIGS. 7 and 11, the present roller members 86 and 88 are designed so as to increase the strength of the respective shafts, and the shafts associated with such roller members are not threaded, which threads reduce the overall diameter of the shaft. Instead, the present roller members are made with integral shafts of a much larger diameter that is approximately 10 times stronger than existing cam roller stems used on known machines in the marketplace. The shafts run in large self aligning bearings. This arrangement is capable of withstanding forces required for closing Pittsburgh Seams made of 18 gauge stainless steel and 16 gauge mild steel. This strengthening of the roller members 86 and 88 prevents premature breakage of such roller members and greatly increases the longevity and efficiency of the seam closing process. This increased strength associated with the forming roller members in conjunction with the support provided by the V-shaped roller member 86 to all sides of the Pittsburgh Seam during the seam closing process allows the present apparatus 24 to successfully close Pittsburgh Seams made of metal from extremely light gauge metal such as 26 gauge metal through heavy gauge metal such as 16 gauge metal without the need to adjust the roller members for a tighter or looser setting. The use of the present lower and upper V-shaped guide members 34 and 56 in conjunction with the improved lower and upper clamp members 40 and 60 likewise contribute to the successful seaming of a wide variety of different gauge materials from extremely light to heavy gauge metal as previously described.

Figure 13:
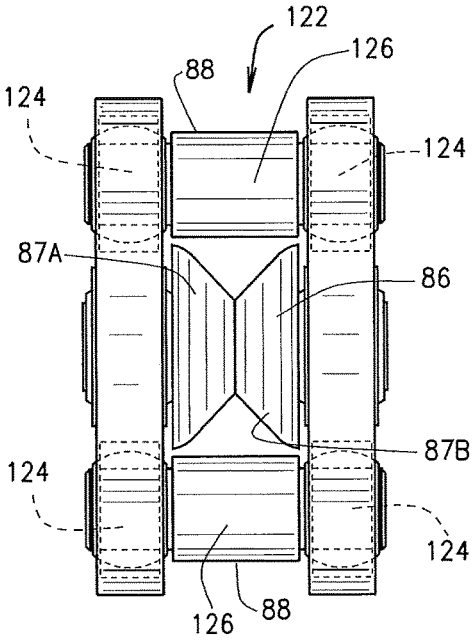
FIG. 13 is a partial front elevational view of another embodiment of a seam forming carriage assembly constructed in accordance with the teachings of the present invention.
Figure 14:
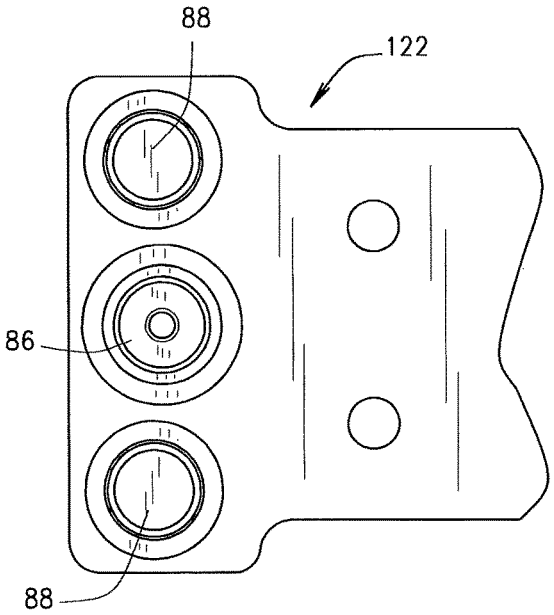
FIG. 14 is a partial side elevational view of the carriage assembly of FIG. 13.

FIGS. 13 and 14 illustrate still another embodiment of a carriage system 122 which includes three roller members 86 and 88 mounted in vertical arrangement relative to each other, the lower roller member 88 being substantially cylindrical in shape, the middle or center roller member 86 being substantially V-shaped in configuration, and the upper roller member 88 being again substantially cylindrical in shape. The roller members 86 and 88 are substantially identical to the roller members utilized in carriage assembly 82 (FIGS. 6 and 7), the only difference being that a roller member 88 has been positioned both above and below the V-shaped roller member 86. All three seam forming roller members 86 and 88 are positioned on the movable carriage assembly 122 which is guided on the same vertical track system 32 as previously explained. The carriage assembly 122 is likewise substantially identical in structure, configuration, function and operation as carriage assembly 82 and includes chain attachment pins (not shown) such as the attachment pins 90 and 92 as well as a plurality of guide wheels (not shown) such as the guide wheels 94 illustrated in FIGS. 6 and 7. Except for the use of two substantially cylindrical roller members 88, one above and one below the V-shaped roller member 86, carriage member 122 is substantially identical in all respects as previously described with respect to carriage assembly 82.

Carriage assembly 122 is more efficient than carriage assembly 82 and the dual carriage system utilizing carriage assemblies 82 and 120 explained above since carriage assembly 122 can accomplish complete closure of a typical Pittsburgh Seam in a single pass in either direction, that is, either from its lower starting point to its upper finishing point, or from its upper finishing point to its lower starting point. In essence, carriage assembly 122 incorporates the features of carriage assemblies 82 and 120 discussed with respect to the dual carriage system and rolls these features into a single carriage unit. When activated, the carriage assembly 122 moves in a vertical direction from its lower start position adjacent the lower guide members 34 to an upper position determined by the positioning and location of the upper clamp head assembly 52 and support member 66. As the carriage assembly 122 moves in an upward direction, the substantially cylindrically shaped upper roller member 88 initially bends the overhanging seam edge portion 22 approximately 45° and then the center or middle V-shaped roller member 86 completes the closing of the seam and moves the overhanging edge portion 22 into a tight abutting relationship with the outer surface of the duct section as previously explained with respect to carriage assembly 82. The side portions 87A and 87B of the V-shaped roller member 86 function as previously explained with respect to carriage assembly 82, that is, the side portion of the V-shaped roller member 86 not being used to form or close the seam, for example, side portion 87A adjacent the female portion 14, holds one side of the duct section and supports that side of the duct section so that the opposite side portion of the roller member 86, namely, side portion 87B, presses against the overhanging edge portion 22 to create the bending or forming force. The function and operation of the V-shaped roller member 86 and the upper substantially cylindrically shaped roller member 88 is identical to that previously explained with respect to carriage assembly 82. The lower or bottom substantially cylindrically shaped roller member 88 will function to add more stability to the carriage assembly 122 during the closing process and during the application of the bending and forming forces but it will not interfere with the seam closing process during upward travel of the carriage assembly 122. Once carriage assembly 122 reaches its upper position, the Pittsburgh Seam has been fully closed and the duct section can be removed and/or rotated so that another seam can be positioned on the present apparatus 24 for closure.

Still further, and importantly, since carriage assembly 122 includes a substantially cylindrically shaped roller member 88 both above and below the V-shaped roller member 86, the lower substantially cylindrically shaped roller member 88 will now function to initially bend the overhanging seam edge portion 22 approximately 45° when the carriage assembly 122 is moved downwardly in a vertical direction from its upper position to its lower start position and the middle or center V-shaped roller member 86 will then again complete the closing of the seam as the carriage assembly 122 moves to its initial start position. During this return run, the upper substantially cylindrically shaped roller member 86 now functions to add more stability to the carriage assembly 122 during the closing process but it will not interfere with such process during the downward travel of the carriage assembly 122. As a result, carriage assembly 122 can complete the closing of a Pittsburgh Seam both during its upward travel as well as during its downward or return travel thereby eliminating the return travel of carriage 82 as well as the more complicated dual carriage system utilizing carriage assemblies 82 and 120. This results in more efficient use of the present apparatus and increases the productivity of the machine since a Pittsburgh Seam can be closed in a single pass in either direction both during its upward travel as well as during its downward travel.

Figure 15:
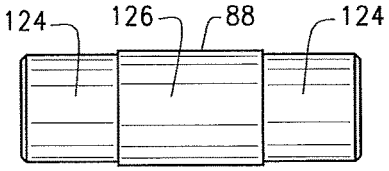
FIG. 15 is a front elevational view of the substantially cylindrical roller members associated with the carriage assembly of FIGS. 13 and 14.
Figure 16:
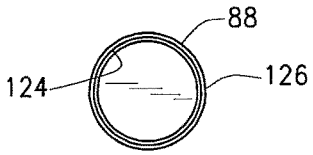
FIG. 16 is a side elevational view of the substantially cylindrical roller members of FIG. 15.

FIGS. 15 and 16 illustrate one embodiment of the substantially cylindrically shaped roller member 88 utilized in carriage assemblies 82, 120 and 122. Side end portions 124 of roller member 88 form shaft portions for mounting to the carriage assemblies 82, 120 and 122. Shaft portions 124 can be formed so as to be of a slightly smaller diameter as compared to the center roller portion 126, the shaft portions 124 being substantially larger than the known prior art as previously explained. The shaft portions 124 are cooperatively receivable within the side plates associated with the respective carriage assemblies such as carriage assembly 122 as best illustrated in FIG. 13. It is also recognized and anticipated that the roller members 88 could be substantially the same diameter throughout their entire length, and that other configurations are likewise possible.

It is also recognized that the substantially cylindrically shaped roller members 88 utilized in carriage assembly 122 can likewise be replaced with a flat plate or wiper block 118 as previously described with respect to FIGS. 11 and 12. In this regard, the flat plates or wiper blocks 118 would function and operate in the same capacity as roller members 88 to complete the sealing of a typical Pittsburgh Seam in a single pass in either direction. Here again, roller members 88 can be replaced with any object that is shaped and configured so as to initially bend the overhanging edge portion 22 of a typical Pittsburgh Seam 10 to approximately a 45° angle as previously explained so as to allow the V-shaped roller member 86 to complete the seaming process.

It is also recognized that any plurality of seam forming members can be positioned within any carriage assembly to both initially bend the overhanging seam edge portion associated with a Pittsburgh Seam and to close the Pittsburgh Seam regardless of the orientation of the male and female portions of the seam. It is also recognized and anticipated that any plurality of members can be mounted within a particular carriage assembly to initially bend the overhanging seam edge portion, and it is also recognized and anticipated that any plurality of seam forming members can be positioned within a particular carriage assembly to close the Pittsburgh Seam. In this regard, various examples of different arrangements of seam forming members within a particular carriage assembly will be discussed hereinafter with respect to FIGS. 17-24. Although the various seam forming member arrangements illustrated in FIGS. 17-24 are for illustrative purposes only, it is recognized that still other arrangements are likewise envisioned and anticipated.

Figure 17:
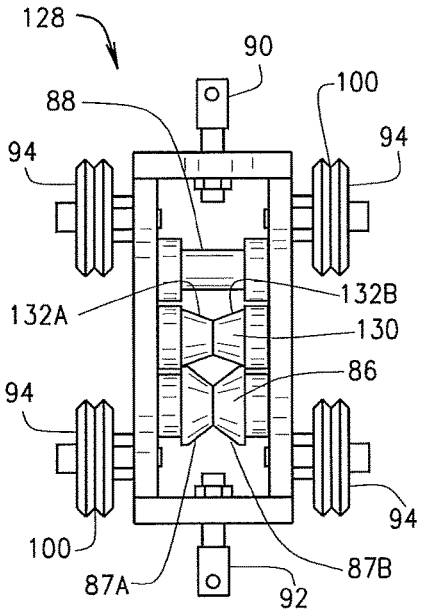
FIG. 17 is a front elevational view of another embodiment of a seam forming carriage assembly constructed in accordance with the teachings of the present invention.
Figure 18:
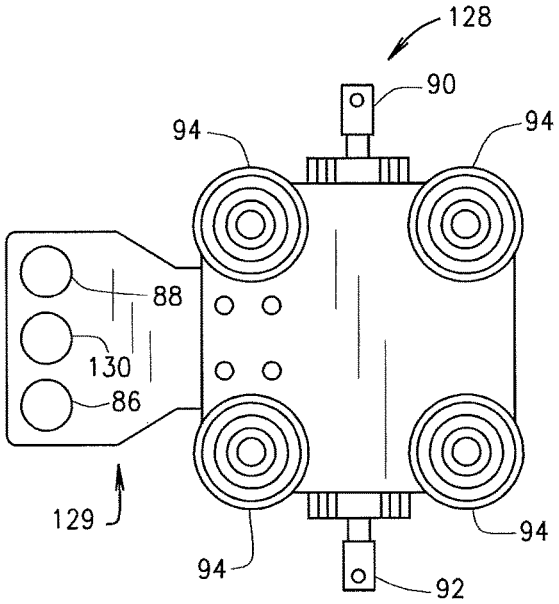
FIG. 18 is a side elevational view of the carriage assembly of FIG. 17.

FIGS. 17 and 18 illustrate still another embodiment of a carriage system 128 which includes another embodiment of the present seal forming assembly 129 which again includes three roller members 88, 130 and 86 mounted in a vertical arrangement relative to each other. In seal forming assembly 129, the upper roller member 88 is again substantially cylindrical in shape as previously explained, the middle or center roller member 130 is substantially V-shaped in configuration but having a different slope or taper associated with its side portions 132A and 132B as compared to the substantially V-shaped lower roller member 86 as previously explained. As best illustrated in FIG. 17, the slope or taper associated with the respective side portions 132A and 132B of roller member 130 is considerably smaller or less than the slope or taper associated with the side portions 87A and 87B of roller member 86.

Figure 28:
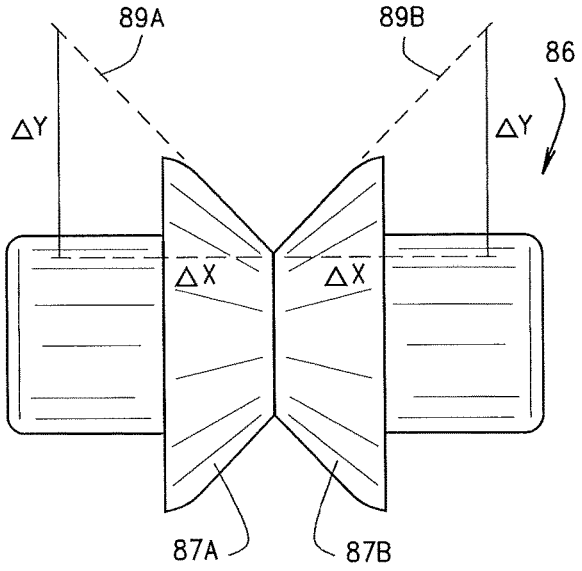
FIG. 28 is an enlarged front elevational view of one of the substantially V-shaped roller members constructed in accordance with the teachings of the present invention.

The slope or taper associated with the respective side portions of any of the substantially V-shaped roller members is best illustrated in FIG. 28. FIG. 28 is an enlarged front elevational view of V-shaped roller member 86 having side portions 87A and 87B associated respectively therewith. The slope of side portions 87A and 87B can be calculated by taking the slope of the line segments 89A and 89B which represent the slope of the outer surfaces of side portions 87A and 87B. The slope of each line segment 89A and 89B can be easily calculated by picking two spaced apart points on each respective line segment 89A and 89B and dividing the change in the Y-direction ($\Delta Y$) over the change in the X-direction ($\Delta X$), where slope=$\Delta Y/\Delta X$. As the slope or taper associated with the side portions of each respective substantially V-shaped roller member changes, so does the amount of closing that that particular roller member performs on the Pittsburgh Seam.

As illustrated in FIG. 17, the slope or taper associated with side portions 132A and 132B of roller member 130 is less than the slope associated with the respective side portions 87A and 87B of roller member 86. That is, side portions 87A and 87B are steeper than side portions 132A and 132B. As the slope or taper of the side walls of any particular substantially V-shaped roller member increases, so does the amount of closing of the Pittsburgh Seam as that particular roller member passes over the Pittsburgh Seam. Likewise, the smaller or shallower the slope or taper associated with a particular substantially V-shaped roller member, a smaller portion of the closing will occur as that particular roller member traverses the Pittsburgh Seam.

Again referring to FIG. 17 and substantially V-shaped roller members 130 and 86, because the slope or taper of the side portions of roller member 130 are less than the slope or taper associated with the respective side portions of roller member 86, this means that roller member 130 will not completely close the Pittsburgh Seam as the carriage assembly 128 moves upwardly from its lower position to its upper position as previously described. Instead, the V-shaped roller member 130 will start the closing of the Pittsburgh Seam and will initially close or move the Pittsburgh Seam to a first pre-determined amount or position towards closing and then V-shaped roller member 86 will complete the closing of the Pittsburgh Seam and will move the Pittsburgh Seam to its final closing position. Therefore, as the carriage assembly 128 moves in a vertical direction from its lower start position adjacent the lower guide members 34 as illustrated in FIGS. 2 and 3 to an upper position determined by the position and location of the upper clamp head assembly 52 and support member 66, the substantially cylindrically shaped roller member 88 will initially bend the overhanging seam edge portion of the Pittsburgh Seam approximately 45° and then the middle V-shaped roller member 130 will start the closing of the Pittsburgh Seam by moving the overhanging seam edge portion a first pre-determined amount towards its fully closed position. Subsequently, the bottom V-shaped roller member 86 will then engage the overhanging seam edge portion and complete the closing of the seam by moving the overhanging edge portion into a tight abutting relationship with the outer surface of the duct section as previously explained. In this particular embodiment, two substantially V-shaped roller members having different slopes or tapers associated with their respective side portions are utilized to complete the closing of the Pittsburgh Seam.

It is also recognized that carriage assembly 128 will only complete the closing of a Pittsburgh Seam as it travels upward from its first position to its second position. Due to the arrangement of roller members 88, 130 and 86, return travel of the carriage assembly 128 from its second position to its first position will not complete the closing of a Pittsburgh Seam as previously discussed with respect to carriage assembly 122. As will be hereinafter further discussed, carriage assembly 128 could be further modified so that it can likewise complete the closing of a Pittsburgh Seam on its return travel from its second position to its first position.

Figure 19:
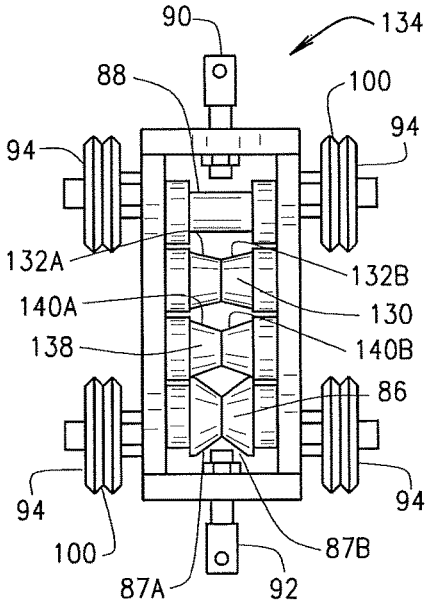
FIG. 19 is a front elevational view of still another embodiment of a seam forming carriage assembly constructed in accordance with the teachings of the present invention.
Figure 20:
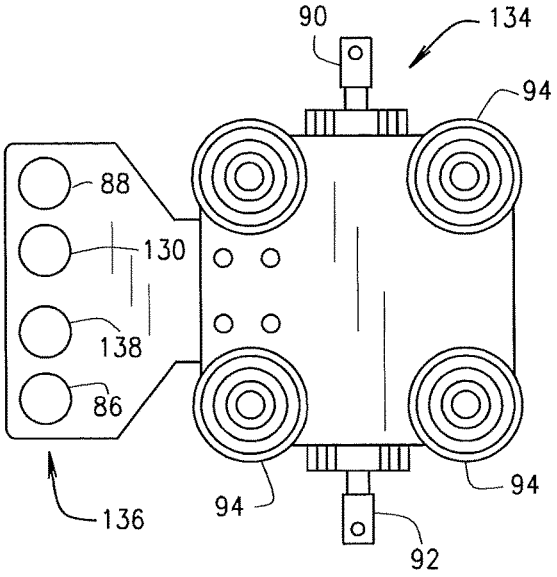
FIG. 20 is a side elevational view of the carriage assembly of FIG. 19.

FIGS. 19 and 20 illustrate still another embodiment of a carriage system 134 which includes another embodiment of the present seam forming assembly 136. The seam forming assembly 136 illustrated in FIGS. 19 and 20 includes four roller members 88, 130, 138 and 86 mounted in a vertical arrangement relative to each other, the upper roller member 88 again being substantially cylindrical in shape, and roller members 130, 138 and 86 being substantially V-shaped in configuration with the slope or taper of the side portions 140A and 140B associated with roller member 138 being greater than the slope or taper of side portions 132A and 132B of roller member 130, and with the slope or taper of side portions 87A and 87B of roller member 86 being greater than the slope or taper of side portions 140A and 140B associated with roller member 138. In this particular embodiment, three substantially V-shaped roller members are utilized to completely close the Pittsburgh Seam. Roller members 86, 88 and 130 are as previously described and substantially V-shaped roller member 138 is constructed such that the slope or taper of its respective side portions 140A and 140B is greater than the slope or taper associated with the side portions of roller member 130 but are less than the slope or taper associated with the side portions of roller member 86. In this particular embodiment, as carriage assembly 134 moves in an upward direction from its first position to its second position as previously explained, the substantially cylindrically shaped roller member 88 will again initially bend the overhanging seam edge portion approximately 45°; substantially V-shaped roller member 130 will start the closing process and will initially move the overhanging seam edge portion a first pre-determined amount towards its closing position; substantially V-shaped roller member 138 will then continue the closing process and will move the overhanging seam edge portion a second pre-determined amount towards its closing position; and substantially V-shaped roller member 86 will complete the closing process and will move the overhanging seam edge portion to its fully closed position as previously explained. Here again, carriage assembly 134 will only completely close a Pittsburgh Seam as it travels upward from its first position to its second position.

As illustrated in FIGS. 17-20, it is recognized and anticipated that any plurality of seam forming members such as seam forming members 130, 138 and 86 can be utilized to completely close a Pittsburgh Seam. In this regard, each substantially V-shaped roller member used to completely close a Pittsburgh Seam will have a different slope or taper associated with its respective side portions as previously discussed with respect to roller members 130, 138, and 86. This slow transition to completely close the Pittsburgh Seam once the overhanging edge portion has been initially bent to approximately a 45 degree angle as previously explained can be utilized to increase the efficiency of the closure of the seam and to reduce wear and tear as well as fatigue on the overhanging seam edge portion during the closing process. Use of any number of substantially V-shaped roller members to close a particular Pittsburgh Seam can likewise be dictated by other factors.

Figure 21:
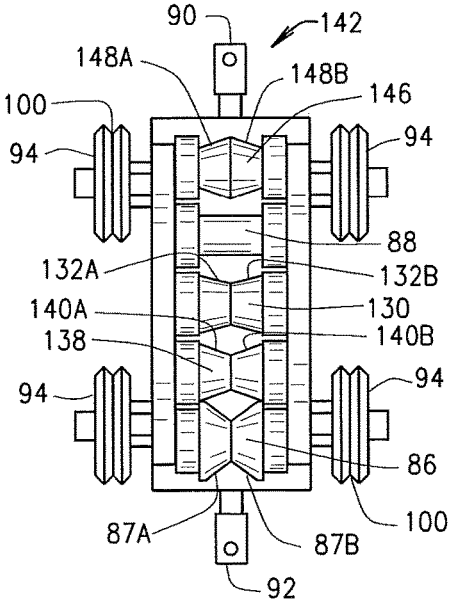
FIG. 21 is a front elevational view of still another embodiment of a seam forming carriage assembly constructed in accordance with the teachings of the present invention.
Figure 22:
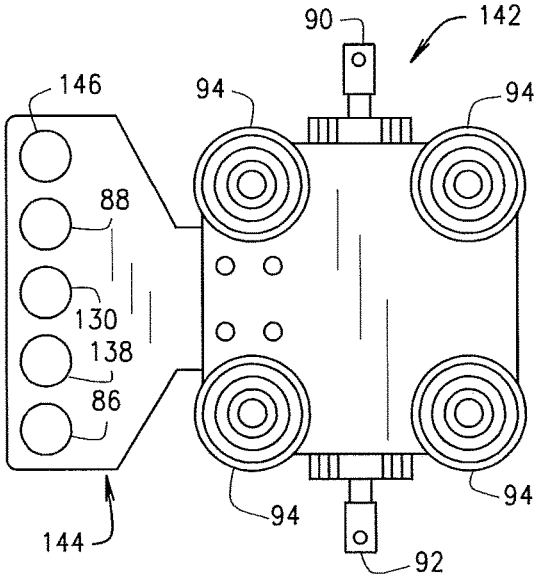
FIG. 22 is a side elevational view of the carriage assembly of FIG. 21.

As previously discussed, it is also recognized and anticipated that any number of seam forming rollers can likewise be utilized to initially bend the overhanging seam edge portion to approximately 45° so that the substantially V-shaped roller members can then complete the closing of the Pittsburgh Seam. In this regard, FIGS. 21 and 22 illustrate still another embodiment of a carriage system 142 which includes still another embodiment of the present seam forming assembly 144 which includes five roller members 146, 88, 130, 138 and 86 again mounted in a substantially vertical arrangement relative to each other. In this particular arrangement, roller members 146 and 88 are utilized to initially bend the overhanging seam edge portion to approximately 45°, and roller members 130, 138 and 86 are utilized to close the Pittsburgh Seam as previously described with respect to carriage assembly 134. Roller members 88, 130, 138 and 86 have all been previously described with respect to FIGS. 6, 13, 17 and 19. In this particular embodiment, roller member 146 is configured to initially bend the overhanging seam edge portion a first pre-determined amount and roller member 88 is then utilized to further bend the overhanging seam edge portion to a second pre-determined amount such that roller members 130, 138 and 86 can then complete the closing of the Pittsburgh Seam. To this extent, roller member 146 is a substantially inverted V-shaped configured roller member having respective side portions 148A and 148B as illustrated in FIG. 21. Here again, the slope or taper of side portions 148A and 148B of roller member 146 will dictate how far the roller member 146 will initially bend the overhanging seam edge portion of the Pittsburgh Seam. As previously described, the overhanging seam edge portion of the Pittsburgh Seam needs to be initially bent at least approximately 45° such that the remaining roller members can then complete the closing of the seam and move the overhanging edge portion into a tight abutting relationship with the duct section.

It is also recognized and anticipated that the initial bending of the overhanging seam edge portion can be less than 45° and it can likewise be more than 45°, and the respective roller members can be configured to continue to subsequently engage the overhanging seam edge portions so as to move it to its final closing position. In the configuration illustrated in FIG. 21, the side portions 148A and 148B of roller member 146 are sloped or tapered so as to initially bend the overhanging seam edge portion approximately 22½°. Obviously; as the slope or taper of the roller side portions 148A and 148B are either increased or decreased, the amount of the initial bending of the overhanging seam edge portion will likewise change. Once roller member 146 initially bends the overhanging seam edge portion of a Pittsburgh Seam to a first pre-determined amount, the substantially cylindrically shaped roller member 88 as previously explained will continue the initial bending of the overhanging seam edge portion and will bend the seam edge portion to a second pre-determined amount which will be approximately 45°. At this point, the substantially V-shaped roller members 130, 138 and 86 will then continue to bend the overhanging seam edge portion as previously explained with respect to seam forming assembly 136 so as to complete the closing of the Pittsburgh Seam. It is also recognized that a plurality of substantially inverted V-shaped roller members could also be used to initially bend the overhanging seam edge portion to approximately 45°, thereby eliminating the need for roller member 88. Here again, carriage assembly 142 and seam forming assembly 144 will complete the closing of a Pittsburgh Seam as the carriage assembly 142 is moved in an upward direction from its first position to its second position as previously explained.

As with the plurality of substantially V-shaped roller members 130, 138 and 86 that can be utilized to complete the closing of a Pittsburgh Seam, any plurality of roller members 146 and 88 can likewise be utilized to initially bend the overhanging seam edge portion associated with a Pittsburgh Seam when the duct section is placed within the present apparatus. Like the varying slopes or tapers associated with the roller members 130, 138 and 86, a plurality of roller members similar to roller member 146 could likewise be utilized to initially bend the overhanging seam edge portion, each of the roller members similar to roller member 146 having a different slope or taper associated with each of the side portions of respective roller member. Here again, any plurality of roller members can be shaped and utilized to initially bend the overhanging seam edge portion of a Pittsburgh Seam to approximately 45°, and any plurality of substantially V-shaped roller members can be utilized to thereafter complete the closing of the Pittsburgh Seam when the carriage assembly is moved in an upward direction from its first position to its second position.

It is also recognized that the carriage assemblies 128, 134 and 142 (FIGS. 17, 19 and 21) can likewise be configured such that the respective carriage assemblies can likewise completely close a Pittsburgh Seam when the carriage assembly also moves in a downward direction from its second position to its first position as described with respect to carriage assembly 122 (FIGS. 13 and 14).

Figure 23:
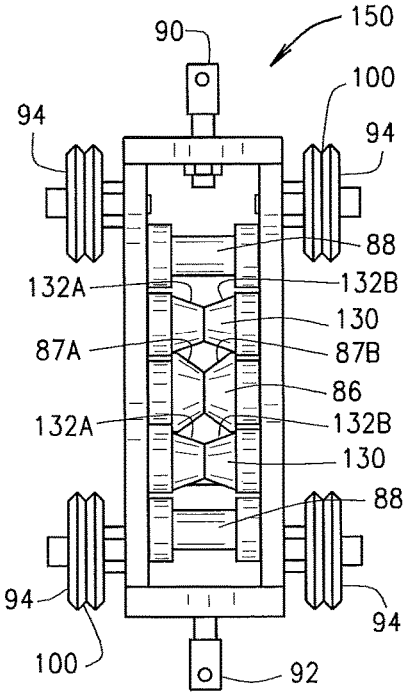
FIG. 23 is a front elevational view of yet another embodiment of a seam forming carriage assembly constructed in accordance with teachings of the present invention.
Figure 24:
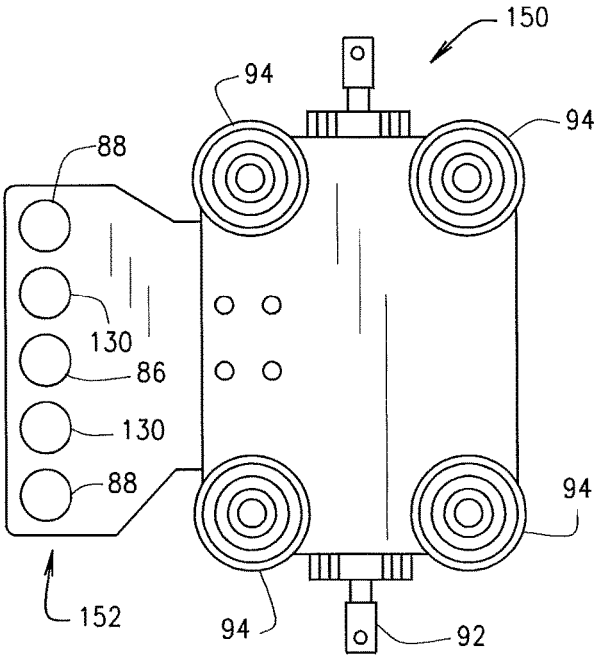
FIG. 24 is a side elevational view of the carriage assembly of FIG. 23.

In this regard, FIG. 23 illustrate still another embodiment of a carriage assembly 150 having a seam forming assembly 152 wherein seam forming assembly 152 is substantially identical to seam forming assembly 129 except that roller members 130 and 88 have likewise been positioned at the bottom portion of carriage assembly 128 underneath the substantially V-shaped roller member 86. Roller members 86, 88 and 130 are substantially identical to the roller members utilized in carriage assembly 128, the only difference being that roller member 130 has also been positioned below roller member 86 and roller member 88 has also been positioned below roller member 130 as illustrated in FIG. 23. Stated differently, roller members 130 and 88 have been positioned both above and below the V-shaped roller member 86 such that the carriage assembly 150 will be able to close a Pittsburgh Seam both as it moves upwardly from its first position to its second position, and as it moves downwardly from its second position to its first position.

In this regard, as carriage assembly 150 moves in a vertical direction from its first position adjacent to lower guide member 34 to its second position adjacent the upper clamp head assembly 52 and support member 66, roller member 88 will initially bend the overhanging seam edge portion and the substantially V-shaped roller members 130 and 86 will complete the closing of the Pittsburgh Seam as previously explained. When the carriage assembly 150 is moved from its second position to its first position, roller member 88 located at the bottom portion of carriage assembly 150 will again initially bend the overhanging seam edge portion and roller member 130 located below roller member 86 as well as roller member 86 will then close the Pittsburgh Seam as the carriage assembly 150 moves from its second position to its first position. During its upward travel, the lower substantially cylindrically shaped roller member 88 and the lower substantially V-shaped roller member 130 will function to add more stability to the carriage assembly 150 during the closing process but these roller members will not interfere with such process during the upward travel of the carriage assembly. In similar fashion, during its return run from its second position to its first position, the upper substantially cylindrically shaped roller member 88 and the upper substantially V-shaped roller member 130 will now function to add more stability to the carriage assembly 150 during the closing process but they again will not interfere with such process during the downward travel of the carriage assembly 150. As a result, carriage assembly 150 can complete the closing of a Pittsburgh Seam both during its upward travel as well as during its downward travel as previously explained with respect to carriage assembly 122 illustrated in FIGS. 13 and 14.

Figure 25:
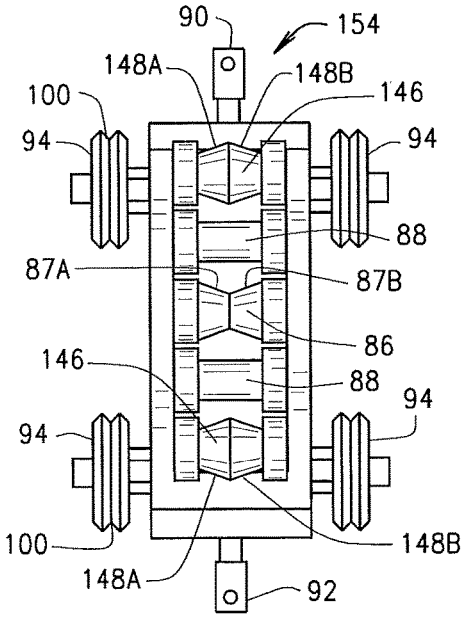
FIG. 25 is a front elevational view of still another embodiment of a seam forming carriage assembly constructed in accordance with the teachings of the present invention.
Figure 26:
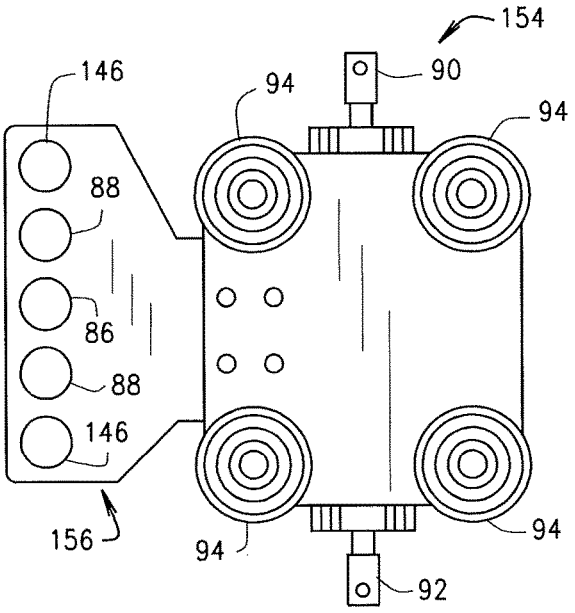
FIG. 26 is a side elevational view of the carriage assembly of FIG. 25.

FIGS. 25 and 26 illustrate still another embodiment of a carriage system 154 having a seam forming assembly 156 which includes five roller members which are configured to allow carriage member 154 to again complete the closing of a Pittsburgh Seam in a single pass both during its travel upwardly from its first position to its second position, and in its travel downwardly from its second position to its first position. Carriage member 154 includes roller members 146 and 88 which are positioned and located both above and below the substantially V-shaped roller member 86, roller members 146 and 88 combining to initially bend the overhanging seam edge portion of a Pittsburgh Seam to approximately 45° either during its upward travel or during its downward travel and the substantially V-shaped roller member 86 completing the closing of the Pittsburgh Seam as previously explained. Here again, carriage assembly 154 can complete the closing of a Pittsburgh Seam both during its upward travel as well as during its downward travel similar to carriage assembly 150.

Based upon the various carriage and seam forming assemblies illustrated in FIGS. 13, 14 and 17-26, it is recognized that any plurality of seam forming members can be positioned within a carriage assembly to complete the closing of a Pittsburgh Seam in a single pass during travel of the carriage assembly between its first and second positions, as well as between its second and first positions as previously explained. It is also recognized that any plurality of seam forming members can be shaped to initially bend the overhanging Pittsburgh Seam edge portion so that the remaining seam forming members can close the Pittsburgh Seam, and it is recognized that any plurality of seam forming members can be shaped to close the Pittsburgh Seam as likewise previously explained. In addition, out of any plurality of seam forming members, it is recognized that at least one of the plurality of seam forming members can be configured to initially bend the overhanging Pittsburgh Seam edge portion and at least one of said plurality of seam forming members can be configured to close the Pittsburgh Seam when the carriage assembly moves either between its first and second positions, and/or between its second and first positions. It is also recognized that the at least one of any plurality of seam forming members that initially bend the overhanging Pittsburgh Seam edge portion can include at least one cylindrically shaped roller member, at least one flat plate, at least one wiper blade, and/or a plurality of substantially inverted V-shaped roller members wherein the slope or taper of the inverted V-shaped side portions of the roller members have varying degrees of slope or taper.

Figure 27:
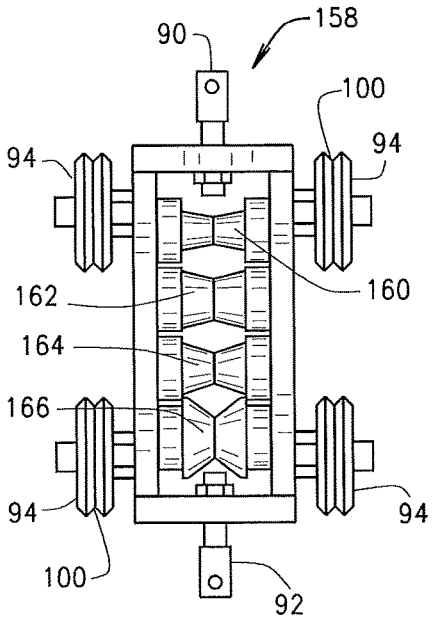
FIG. 27 is a front elevational view of yet another embodiment of a seam forming carriage assembly constructed in accordance with the teachings of the present invention.

FIG. 27 illustrates still another embodiment of a carriage system 158 which includes still another embodiment of the present seam forming assembly which includes a plurality of substantially V-shaped roller members 160, 162, 164 and 166 again mounted in a substantially vertical arrangement relative to each other wherein the substantially V-shaped roller members are utilized to both initially bend the overhanging Pittsburgh Seam edge portion as well as completing the closing of the Pittsburgh Seam as the carriage assembly 158 moves from its first position to its second position. As previously explained, the slope or taper associated with the side portions of each respective V-shaped roller member progressively increases from the top roller member 160 to the bottom roller member 166 as the carriage assembly moves in an upward direction from its first position to its second position. In this particular embodiment, roller member 160, or roller members 160 and 162, initially bend the overhanging Pittsburgh Seam edge portion to approximately 45°, and roller members 164 and 166, or roller members 162, 164 and 166, complete the closing of the Pittsburgh Seam as previously explained. Although only four substantially V-shaped roller members are illustrated in embodiment 158 of FIG. 27, it is recognized and anticipated that any plurality of substantially V-shaped roller members can be utilized in any particular carriage assembly to both initially bend the overhanging Pittsburgh Seam edge portion to approximately 45° and to then complete the closing of the Pittsburgh Seam as the carriage assembly moves from its first position to its second position.

It is also recognized and anticipated that other seam forming roller members can be differently shaped and configured in a wide variety of different configurations and still accomplish the initial bending of the overhanging Pittsburgh Seam edge portion as well as the closing of the Pittsburgh Seam when the carriage assembly moves either between its first and second positions, and/or between its second and first positions as previously explained.

Still further, because an operator can position a particular duct section to be seamed on the present apparatus 24 without regard to the particular orientation of the Pittsburgh Seam positioned between the guide members 34 and 56, the present apparatus saves considerable time and is substantially more cost effective with respect to orienting a duct section on the present apparatus as compared to known prior art Pittsburgh Seam closing devices. This means that an operator can take any duct section, whether such duct section is positioned in a random pattern adjacent the seam closing apparatus or whether such duct section is coming directly off of a duct forming assembly line, and place the duct section in a vertical orientation on the support surface 28 of the present apparatus 24 such that the Pittsburgh Seam to be closed is guided by the V-shaped guide members 34 and 56 to the seam forming assembly without worrying about the specific orientation of the Pittsburgh Seam to be closed, that is, without worrying about on which side the overhanging edge portion 22 of a typical Pittsburgh Seam 10 projects relative to the positioning of the seam forming assembly. This positioning of a Pittsburgh Seam to be closed on the present apparatus regardless of the orientation of such seam saves substantial time and labor and greatly improves the efficiency of the entire process, both in forming a particular duct section and moving such formed duct section to the seam closure apparatus 24, and in efficiently closing the Pittsburgh Seam. Although the present apparatus does not completely eliminate the need for peening the opposed end portions of a particular Pittsburgh Seam to be closed, it greatly improves and speeds up the overall seam closing process. An operator simply needs to stand the duct section on end in a vertical orientation and move the duct section directly to the support surface 28 and in between the guide members 34 and 56. No specific orientation is necessary.

Other variations and modifications to the various components and assemblies comprising the present structure 24 are also contemplated and envisioned.

Thus, there has been shown and described several embodiments of a vertical Pittsburgh Seam closing apparatus which fulfills the objects and advantages sought therefor. Many changes, modifications, variations and other uses in applications of the present invention will, however, become apparent to those skilled in the art after considering this specification and the accompanying drawings. All such changes, modifications, variations and other uses in applications which do not depart from the spirit and scope of the present invention are deemed to be covered by the invention and all equivalents therefor.

The invention claimed is:

1. An apparatus for closing a Pittsburgh Seam associated with a duct section, the duct section having first and second end portions, the Pittsburgh Seam to be closed having a male portion, a female portion, and an overhanging edge portion, the apparatus comprising:

a base member having a supporting surface for positioning a duct section in a vertical orientation thereon;

a lower guide assembly for guiding the Pittsburgh Seam to be closed associated with the first end portion of the duct section into proper position on the supporting surface of the base member;

an upper guide assembly for guiding the Pittsburgh Seam to be closed associated with the second end portion of the duct section into proper position on the apparatus;

a lower clamping member positionable inside the first end portion of the duct section adjacent an inside portion of the Pittsburgh Seam to be closed;

an upper clamping member positionable inside the second end portion of the duct section adjacent the inside portion of the Pittsburgh Seam to be closed;

a vertical track mechanism extending upwardly from the base member; and a carriage assembly movable on said track mechanism between a first position located in the vicinity of said lower guide assembly and a second position located in the vicinity of said upper guide assembly for closing a Pittsburgh Seam, said carriage assembly including a seam forming assembly for engaging an outside portion of the Pittsburgh Seam to be closed;

said seam forming assembly including any plurality of members mounted in vertical arrangement, at least one of said plurality of seam forming members being shaped to initially bend the overhanging seam edge portion, and at least one of said plurality of seam forming members being a roller member having a substantially V-shaped configuration;

said seam forming assembly traversing substantially the entire length of the duct section when the carriage assembly moves between its first and second positions, at least one of said plurality of seam forming members initially bending the overhanging Pittsburgh Seam edge portion while the at least one of said seam forming members having a substantially V-shaped configuration completing the closing of the Pittsburgh Seam regardless of the orientation of the male and female portions of the Pittsburgh Seam when the duct section is positioned within the lower and upper guide members and when the carriage assembly moves between its first and second positions.

2. The apparatus defined in claim 1 wherein said seam forming assembly likewise traverses substantially the entire length of the duct section when the carriage assembly moves between its second and first positions, at least one of said plurality of seam forming members initially bending the overhanging Pittsburgh Seam edge portion and at least one of said plurality of said substantially V-shaped roller members completing the closing of the Pittsburgh Seam when the duct section is positioned within the lower and upper guide members and when the carriage assembly moves between its second and first positions.

3. The apparatus defined in claim 1 wherein at least two of said plurality of seam forming members initially bend the overhanging Pittsburgh Seam edge portion, one of said at least two of said plurality of seam forming members bending the overhanging Pittsburgh Seam edge portion a first predetermined amount and the other of said at least two of said plurality of seam forming members bending the overhanging Pittsburgh Seam edge portion a second predetermined amount.

4. The apparatus defined in claim 1 wherein at least two of said plurality of seam forming members have a substantially V-shaped configuration for completing the closing of the Pittsburgh Seam, one of said at least two of said plurality of substantially V-shaped seam forming members initially closing the Pittsburgh Seam a first pre-determined amount and the other of said at least two of said plurality of substantially V-shaped seam forming members completing the closing the Pittsburgh Seam.

5. The apparatus defined in claim 1 wherein the at least one of said plurality of seam forming members that initially bend the overhanging Pittsburgh Seam edge portion includes at least one cylindrically shaped roller member.

6. The apparatus defined in claim 1 wherein the at least one of said plurality of seam forming members that initially bend the overhanging Pittsburgh Seam edge portion includes at least one flat plate.

7. The apparatus defined in claim 1 wherein the at least one of said plurality of seam forming members that initially bend the overhanging Pittsburgh Seam edge portion includes at least one wiper blade.

8. The apparatus defined in claim 1 wherein the at least one of said plurality of seam forming members that initially bend the overhanging Pittsburgh Seam edge portion includes at least one substantially V-shaped roller member.

9. The apparatus defined in claim 1 wherein the at least one of said plurality of seam forming members that initially bend the overhanging Pittsburgh Seam edge portion includes at least one substantially inverted V-shaped roller member.

10. The apparatus defined in claim 1 wherein said at least one of said plurality of seam forming members that initially bend the overhanging Pittsburgh Seam edge portion includes a plurality of seam forming members, each seam forming member bending the overhanging Pittsburgh Seam edge portion a pre-determined amount.

11. The apparatus defined in claim 1 wherein said at least one of said plurality of seam forming members having a substantially V-shaped configuration includes a plurality of substantially V-shaped roller members, each substantially V-shaped roller member contributing to the closing of the Pittsburgh Seam regardless of the orientation of the male and female portions of the Pittsburgh Seam when the duct section is positioned within the lower and upper guide members.

12. The apparatus defined in claim 1 wherein all of said plurality of seam forming members are roller members having a substantially V-shaped configuration.

13. An apparatus for closing a Pittsburgh Seam associated with a duct section, the duct section having first and second end portions, the Pittsburgh Seam to be closed having a male portion, a female portion, and an overhanging edge portion, the apparatus comprising:

a base member having a supporting surface for positioning a duct section in a vertical orientation thereon;

a lower guide assembly for guiding the Pittsburgh Seam to be closed associated with the first end portion of the duct section into proper position on the supporting surface of the base member;

an upper guide assembly for guiding the Pittsburgh Seam to be closed associated with the second end portion of the duct section into proper position on the apparatus;

a lower clamping member positionable inside the first end portion of the duct section adjacent an inside portion of the Pittsburgh Seam to be closed;

an upper clamping member positionable inside the second end portion of the duct section adjacent the inside portion of the Pittsburgh Seam to be closed;

a vertical track mechanism extending upwardly from the base member; and a carriage assembly movable on said track mechanism between a first position located in the vicinity of said lower guide assembly and a second position located in the vicinity of said upper guide assembly for closing a Pittsburgh Seam, said carriage assembly being likewise movable from its second position to its first position, said carriage assembly including a seam forming assembly for engaging an outside portion of the Pittsburgh Seam to be closed;

said seam forming assembly including four members mounted in vertical arrangement, at least one of said four members being shaped to initially bend the overhanging seam edge portion, and at least one of said four members being a roller member having a substantially V-shaped configuration;

said seam forming assembly traversing substantially the entire length of the duct section when the carriage assembly moves between its first and second positions, the at least one of said four seam forming members initially bending the overhanging Pittsburgh Seam edge portion while the at least one of said four seam forming members having a substantially V-shaped configuration completes the closing of the Pittsburgh Seam regardless of the orientation of the male and female portions of the Pittsburgh Seam when the duct section is positioned within the lower and upper guide members and when the carriage assembly moves between its first and second positions.

14. The apparatus defined in claim 13 wherein said seam forming assembly likewise traverses substantially the entire length of the duct section when the carriage assembly moves between its second and first positions, at least one of said four seam forming members initially bending the overhanging Pittsburgh Seam edge portion and at least one of said four seam forming members having a substantially V-shaped configuration completing the closing of the Pittsburgh Seam when the duct section is positioned within the lower and upper guide members and when the carriage assembly moves between its second and first positions.

15. The apparatus defined in claim 13 wherein at least two of said four seam forming members initially bending the overhanging Pittsburgh Seam edge portion, one of said at least two of said four seam forming members bending the overhanging Pittsburgh Seam edge portion a first predetermined amount and the other of said at least two of said four seam forming members bending the overhanging Pittsburgh Seam edge portion a second predetermined amount.

16. The apparatus defined in claim 13 wherein at least two of said four seam forming members have a substantially V-shaped configuration for completing the closing of the Pittsburgh Seam, one of said at least two of said four substantially V-shaped seam forming members initially closing the Pittsburgh Seam a first predetermined amount and the other of said at least two of said substantially V-shaped seam foil ling members completing the closing of the Pittsburgh Seam.

17. The apparatus defined in claim 13 wherein two of said seam forming members are shaped to initially bend the overhanging Pittsburgh Seam edge portion and two of said seam forming members are rolling members having a substantially V-shaped configuration.

18. The apparatus defined in claim 17 wherein said two seam forming members having a substantially V-shaped configuration are mounted between said two seam forming members shaped to initially bend the overhanging Pittsburgh Seam edge portion.

19. The apparatus defined in claim 17 wherein one of said two substantially V-shaped roller members has V-shaped side portions that are steeper than the V-shaped side portions associated with the other of said two substantially V-shaped roller members.

20. An apparatus for closing a Pittsburgh Seam associated with a duct section, the duct section having first and second end portions, the Pittsburgh Seam to be closed having a male portion, a female portion, and an overhanging edge portion, the apparatus comprising:

a base member having a supporting surface for positioning a duct section in a vertical orientation thereon;

a lower guide assembly for guiding the Pittsburgh Seam to be closed associated with the first end portion of the duct section into proper position on the supporting surface of the base member;

an upper guide assembly for guiding the Pittsburgh Seam to be closed associated with the second end portion of the duct section into proper position on the apparatus;

a lower clamping member positionable inside the first end portion of the duct section adjacent an inside portion of the Pittsburgh Seam to be closed;

an upper clamping member positionable inside the second end portion of the duct section adjacent the inside portion of the Pittsburgh Seam to be closed;

a vertical track mechanism extending upwardly from the base member; and a carriage assembly movable on said track mechanism between a first position located in the vicinity of said lower guide assembly and a second position located in the vicinity of said upper guide assembly for closing a Pittsburgh Seam, said carriage assembly being likewise movable from its second position to its first position, said carriage assembly including a seam forming assembly for engaging an outside portion of the Pittsburgh Seam to be closed;

said seam forming assembly including five members mounted in vertical arrangement, at least one of said five members being shaped to initially bend the overhanging seam edge portion, and at least one of said five members being a roller member having a substantially V-shaped configuration;

said seam forming assembly traversing substantially the entire length of the duct section when the carriage assembly moves between its first and second positions, the at least one of said five seam forming members initially bending the overhanging Pittsburgh Seam edge portion while the at least one of said five seam forming members having a substantially V-shaped configuration completes the closing of the Pittsburgh Seam regardless of the orientation of the male and female portions of the Pittsburgh Seam when the duct section is positioned within the lower and upper guide members and when the carriage assembly moves between its first and second positions.

21. The apparatus defined in claim 20 wherein said seam forming assembly likewise traverses substantially the entire length of the duct section when the carriage assembly moves between its second and first positions, at least one of said five seam forming members initially bending the overhanging Pittsburgh Seam edge portion and at least one of said five seam forming members having a substantially V-shaped configuration completing the closing of the Pittsburgh Seam when the duct section is positioned within the lower and upper guide members and when the carriage assembly moves between its second and first positions.

22. The apparatus defined in claim 21 wherein at least one of said five members is shaped to initially bend the overhanging seam edge portion when said carriage assembly moves between its first and second positions, and at least one of said five members being shaped to initially bend the overhanging seam edge portion when said carriage member moves between its second and first positions.

23. The apparatus defined in claim 21 wherein the at least one of said five members being a roller member having a substantially V-shaped configuration closing the Pittsburgh Seam when the carriage assembly moves between its first and second positions, and at least one of said five members being a roller member having a substantially V-shaped configuration closing the Pittsburgh Seam when the carriage assembly moves between its second and first positions.

24. The apparatus defined in claim 20 wherein at least one of said five seam forming members initially bends the overhanging Pittsburgh Seamed edge portion when the carriage assembly moves between its first and second positions, and at least another one of said five seam forming members initially bends the overhanging Pittsburgh Seam edge portion when the carriage assembly moves between its second and first positions.

25. The apparatus defined in claim 20 wherein at least two of said five seam forming members have a substantially V-shaped configuration for completing the closing of the Pittsburgh Seam when the carriage assembly moves between its first and second positions, and at least two of said five seam forming members having a substantially V-shaped configuration for completing the closing of the Pittsburgh Seam when the carriage assembly moves between its second and first position.

26. An apparatus for closing a Pittsburgh Seam associated with a duct section, the duct section having first and second end portions, the Pittsburgh Seam to be closed having a male portion, a female portion, and an overhanging edge portion, the apparatus comprising:

a base member having a supporting surface for positioning a duct section in a vertical orientation thereon;

a lower guide assembly for guiding the Pittsburgh Seam to be closed associated with the first end portion of the duct section into proper position on the supporting surface of the base member;

an upper guide assembly for guiding the Pittsburgh Seam to be closed associated with the second end portion of the duct section into proper position on the apparatus;

a lower clamping member positionable inside the first end portion of the duct section adjacent an inside portion of the Pittsburgh Seam to be closed;

an upper clamping member positionable inside the second end portion of the duct section adjacent the inside portion of the Pittsburgh Seam to be closed;

a vertical track mechanism extending upwardly from the base member; and a carriage assembly movable on said track mechanism between a first position located in the vicinity of said lower guide assembly and a second position located in the vicinity of said upper guide assembly for closing a Pittsburgh Seam, said carriage assembly including a seam forming assembly for engaging an outside portion of the Pittsburgh Seam to be closed;

said seam forming assembly including any plurality of members mounted in vertical arrangement, at least two of said plurality of seam forming members being shaped to initially bend the overhanging seam edge portion, and at least one of said plurality of seam forming members being a roller member having a substantially V-shaped configuration;

said seam forming assembly traversing substantially the entire length of the duct section when the carriage assembly moves between its first and second positions, one of said at least two of said plurality of seam forming members initially bending the overhanging Pittsburgh Seam edge portion a first predetermined amount and the other of said at least two of said plurality of seam forming members bending the overhanging Pittsburgh Seam edge portion a second predetermined amount while the at least one of said seam forming members having a substantially V-shaped configuration completing the closing of the Pittsburgh Seam regardless of the orientation of the male and female portions of the Pittsburgh Seam when the duct section is positioned within the lower and upper guide members and when the carriage assembly moves between its first and second positions.

27. An apparatus for closing a Pittsburgh Seam associated with a duct section, the duct section having first and second end portions, the Pittsburgh Seam to be closed having a male portion, a female portion, and an overhanging edge portion, the apparatus comprising:

a base member having a supporting surface for positioning a duct section in a vertical orientation thereon;

a lower guide assembly for guiding the Pittsburgh Seam to be closed associated with the first end portion of the duct section into proper position on the supporting surface of the base member;

an upper guide assembly for guiding the Pittsburgh Seam to be closed associated with the second end portion of the duct section into proper position on the apparatus;

a lower clamping member positionable inside the first end portion of the duct section adjacent an inside portion of the Pittsburgh Seam to be closed;

an upper clamping member positionable inside the second end portion of the duct section adjacent the inside portion of the Pittsburgh Seam to be closed;

a vertical track mechanism extending upwardly from the base member; and a carriage assembly movable on said track mechanism between a first position located in the vicinity of said lower guide assembly and a second position located in the vicinity of said upper guide assembly for closing a Pittsburgh Seam, said carriage assembly including a seam forming assembly for engaging an outside portion of the Pittsburgh Seam to be closed;

said seam forming assembly including any plurality of members mounted in vertical arrangement, at least one of said plurality of seam forming members being shaped to initially bend the overhanging seam edge portion, and at least two of said plurality of seam forming members being a roller member having a substantially V-shaped configuration;

said seam forming assembly traversing substantially the entire length of the duct section when the carriage assembly moves between its first and second positions, at least one of said plurality of seam forming members initially bending the overhanging Pittsburgh Seam edge portion while one of said at least two of said plurality of substantially V-shaped seam forming members initially closing the Pittsburgh Seam a first pre-determined amount and the other of said at least two of said plurality of substantially V-shaped seam forming members completing the closing of the Pittsburgh Seam regardless of the orientation of the male and female portions of the Pittsburgh Seam when the duct section is positioned within the lower and upper guide members and when the carriage assembly moves between its first and second positions.

28. An apparatus for closing a Pittsburgh Seam associated with a duct section, the duct section having first and second end portions, the Pittsburgh Seam to be closed having a male portion, a female portion, and an overhanging edge portion, the apparatus comprising:

a base member having a supporting surface for positioning a duct section in a vertical orientation thereon;

a lower guide assembly for guiding the Pittsburgh Seam to be closed associated with the first end portion of the duct section into proper position on the supporting surface of the base member;

an upper guide assembly for guiding the Pittsburgh Seam to be closed associated with the second end portion of the duct section into proper position on the apparatus;

a lower clamping member positionable inside the first end portion of the duct section adjacent an inside portion of the Pittsburgh Seam to be closed;

an upper clamping member positionable inside the second end portion of the duct section adjacent the inside portion of the Pittsburgh Seam to be closed;

a vertical track mechanism extending upwardly from the base member; and a carriage assembly movable on said track mechanism between a first position located in the vicinity of said lower guide assembly and a second position located in the vicinity of said upper guide assembly for closing a Pittsburgh Seam, said carriage assembly including a seam forming assembly for engaging an outside portion of the Pittsburgh Seam to be closed;

said seam forming assembly including any plurality of members mounted in vertical arrangement, at least one of said plurality of seam forming members being shaped to initially bend the overhanging seam edge portion, the at least one of said plurality of seam forming members that initially bend the overhanging Pittsburgh Seam edge portion includes at least one substantially V-shaped roller member, and at least one of said plurality of seam forming members being a roller member having a substantially V-shaped configuration;

said seam forming assembly traversing substantially the entire length of the duct section when the carriage assembly moves between its first and second positions, at least one of said plurality of seam forming members initially bending the overhanging Pittsburgh Seam edge portion while the at least one of said seam forming members having a substantially V-shaped configuration completing the closing of the Pittsburgh Seam regardless of the orientation of the male and female portions of the Pittsburgh Seam when the duct section is positioned within the lower and upper guide members and when the carriage assembly moves between its first and second positions.

29. An apparatus for closing a Pittsburgh Seam associated with a duct section, the duct section having first and second end portions, the Pittsburgh Seam to be closed having a male portion, a female portion, and an overhanging edge portion, the apparatus comprising:

a base member having a supporting surface for positioning a duct section in a vertical orientation thereon;

a lower guide assembly for guiding the Pittsburgh Seam to be closed associated with the first end portion of the duct section into proper position on the supporting surface of the base member;

an upper guide assembly for guiding the Pittsburgh Seam to be closed associated with the second end portion of the duct section into proper position on the apparatus;

a lower clamping member positionable inside the first end portion of the duct section adjacent an inside portion of the Pittsburgh Seam to be closed;

an upper clamping member positionable inside the second end portion of the duct section adjacent the inside portion of the Pittsburgh Seam to be closed;

a vertical track mechanism extending upwardly from the base member; and a carriage assembly movable on said track mechanism between a first position located in the vicinity of said lower guide assembly and a second position located in the vicinity of said upper guide assembly for closing a Pittsburgh Seam, said carriage assembly including a seam forming assembly for engaging an outside portion of the Pittsburgh Seam to be closed;

said seam forming assembly including any plurality of members mounted in vertical arrangement, at least one of said plurality of seam forming members being shaped to initially bend the overhanging seam edge portion, the at least one of said plurality of seam forming members that initially bend the overhanging Pittsburgh Seam edge portion includes at least one substantially inverted V-shaped roller member, and at least one of said plurality of seam forming, members being a roller member having a substantially V-shaped configuration;

said seam forming assembly traversing substantially the entire length of the duct section when the carriage assembly moves between its first and second positions, at least one of said plurality of seam forming members initially bending the overhanging Pittsburgh Seam edge portion while the at least one of said seam forming members having a substantially V-shaped configuration completing the closing of the Pittsburgh Seam regardless of the orientation of the male and female portions of the Pittsburgh Seam when the duct section is positioned within the lower and upper guide members and when the carriage assembly moves between its first and second positions.

30. An apparatus for closing a Pittsburgh Seam associated with a duct section, the duct section having first and second end portions, the Pittsburgh Seam to be closed having a male portion, a female portion, and an overhanging edge portion, the apparatus comprising:

a base member having a supporting surface for positioning a duct section in a vertical orientation thereon;

a lower guide assembly for guiding the Pittsburgh Seam to be closed associated with the first end portion of the duct section into proper position on the supporting surface of the base member;

an upper guide assembly for guiding the Pittsburgh Seam to be closed associated with the second end portion of the duct section into proper position on the apparatus;

a lower clamping member positionable inside the first end portion of the duct section adjacent an inside portion of the Pittsburgh Seam to be closed;

an upper clamping member positionable inside the second end portion of the duct section adjacent the inside portion of the Pittsburgh Seam to be closed;

a vertical track mechanism extending upwardly from the base member; and a carriage assembly movable on said track mechanism between a first position located in the vicinity of said lower guide assembly and a second position located in the vicinity of said upper guide assembly for closing a Pittsburgh Seam, said carriage assembly including a seam forming assembly for engaging an outside portion of the Pittsburgh Seam to be closed;

said seam forming assembly including any plurality of members mounted in vertical arrangement, a plurality of said any plurality of seam forming members being shaped to initially bend the overhanging seam edge portion, and at least one of said any plurality of seam forming members being a roller member having a substantially V-shaped configuration;

said seam forming assembly traversing substantially the entire length of the duct section when the carriage assembly moves between its first and second positions, each of said plurality of seam forming members initially bending the overhanging Pittsburgh Seam edge portion a pre-determined amount while the at least one of said seam forming members having a substantially V-shaped configuration completing the closing of the Pittsburgh Seam regardless of the orientation of the male and female portions of the Pittsburgh Seam when the duct section is positioned within the lower and upper guide members and when the carriage assembly moves between its first and second positions.

31. An apparatus for closing a Pittsburgh Seam associated with a duct section, the duct section having first and second end portions, the Pittsburgh Seam to be closed having a male portion, a female portion, and an overhanging edge portion, the apparatus comprising:

a base member having a supporting surface for positioning a duct section in a vertical orientation thereon;

a lower guide assembly for guiding the Pittsburgh Seam to be closed associated with the first end portion of the duct section into proper position on the supporting surface of the base member;

an upper guide assembly for guiding the Pittsburgh Seam to be closed associated with the second end portion of the duct section into proper position on the apparatus;

a lower clamping member positionable inside the first end portion of the duct section adjacent an inside portion of the Pittsburgh Seam to be closed;

an upper clamping member positionable inside the second end portion of the duct section adjacent the inside portion of the Pittsburgh Seam to be closed;

a vertical track mechanism extending upwardly from the base member; and a carriage assembly movable on said track mechanism between a first position located in the vicinity of said lower guide assembly and a second position located in the vicinity of said upper guide assembly for closing a Pittsburgh Seam, said carriage assembly including a seam forming assembly for engaging an outside portion of the Pittsburgh Seam to be closed;

said seam forming assembly including any plurality of members mounted in vertical arrangement, at least one of said any plurality of seam forming members being shaped to initially bend the overhanging seam edge portion, and a plurality of said any plurality of seam forming members each being a roller member having a substantially V-shaped configuration;

said seam forming assembly traversing substantially the entire length of the duct section when the carriage assembly moves between its first and second positions, at least one of said any plurality of seam forming members initially bending the overhanging Pittsburgh Seam edge portion while each of said plurality of substantially V-shaped roller members contributes to the closing of the Pittsburgh Seam regardless of the orientation of the male and female portions of the Pittsburgh Seam when the duct section is positioned within the lower and upper guide members and when the carriage assembly moves between its first and second positions.

32. An apparatus for closing a Pittsburgh Seam associated with a duct section, the duct section having first and second end portions, the Pittsburgh Seam to be closed having a male portion, a female portion, and an overhanging edge portion, the apparatus comprising:

a base member having a supporting surface for positioning a duct section in a vertical orientation thereon;

a lower guide assembly for guiding the Pittsburgh Seam to be closed associated with the first end portion of the duct section into proper position on the supporting surface of the base member;

an upper guide assembly for guiding the Pittsburgh Seam to be closed associated with the second end portion of the duct section into proper position on the apparatus;

a lower clamping member positionable inside the first end portion of the duct section adjacent an inside portion of the Pittsburgh Seam to be closed;

an upper clamping member positionable inside the second end portion of the duct section adjacent the inside portion of the Pittsburgh Seam to be closed;

a vertical track mechanism extending upwardly from the base member; and a carriage assembly movable on said track mechanism between a first position located in the vicinity of said lower guide assembly and a second position located in the vicinity of said upper guide assembly for closing a Pittsburgh Seam, said carriage assembly including a seam forming assembly for engaging an outside portion of the Pittsburgh Seam to be closed;

said seam forming assembly including any plurality of members mounted in vertical arrangement, all of said plurality of seam forming members being roller members having a substantially V-shaped configuration;

said seam forming assembly traversing substantially the entire length of the duct section when the carriage assembly moves between its first and second positions, at least one of said plurality of seam forming members initially bending the overhanging Pittsburgh Seam edge portion while the at least one of said seam forming members completing the closing of the Pittsburgh Seam regardless of the orientation of the male and female portions of the Pittsburgh Seam when the duct section is positioned within the lower and upper guide members and when the carriage assembly moves between its first and second positions.

* * * * *